US009758970B2

(12) United States Patent
Grubka et al.

(10) Patent No.: US 9,758,970 B2
(45) Date of Patent: Sep. 12, 2017

(54) LAMINATED HIP AND RIDGE SHINGLE

(71) Applicant: OWENS CORNING INTELLECTUAL CAPITAL, LLC, Toledo, OH (US)

(72) Inventors: Lawrence J. Grubka, Westerville, OH (US); Jennifer Lynn Frey, Monclova, OH (US); Jeffrey W. Smith, Lockport, IL (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 682 days.

(21) Appl. No.: 14/188,957

(22) Filed: Feb. 25, 2014

(65) Prior Publication Data

US 2015/0240496 A1 Aug. 27, 2015

(51) Int. Cl.

| | |
|---|---|
| ***E04D 1/20*** | (2006.01) |
| ***E04D 1/26*** | (2006.01) |
| ***E04D 1/30*** | (2006.01) |

(52) U.S. Cl.

CPC ..... *E04D 1/20* (2013.01); *E04D 1/26* (2013.01); *E04D 2001/305* (2013.01); *Y10T 428/141* (2015.01); *Y10T 428/24752* (2015.01)

(58) Field of Classification Search

CPC ..... E04D 1/20; E04D 1/26; E04D 2001/305; Y10T 428/141; Y10T 428/24752

See application file for complete search history.

(56) References Cited

U.S. PATENT DOCUMENTS 81,579 A 9/1868 Bailey
356,161 A 1/1887 Ricketson
(Continued)

FOREIGN PATENT DOCUMENTS

CA 1207975 7/1986
CA 2697223 A1 * 9/2010 ..... C08L 95/00
(Continued)

OTHER PUBLICATIONS

Office action from U.S. Appl. No. 12/727,459 dated Jun. 6, 2014.
(Continued)

*Primary Examiner* — Nathan Van Sell
(74) *Attorney, Agent, or Firm* — Calfee, Halter & Griswold LLP

(57) ABSTRACT

Hip and ridge shingles may be single layer or laminated. One hip and ridge shingle has a base layer and a dimensional layer affixed to the base layer by an adhesive line that extends in the machine direction and along the width of the base and the dimensional layers. The adhesive line is disposed on only one lateral side of the base layer and dimensional layers to allow movement of another lateral side of the dimensional layer relative to the base layer. Another laminated hip and ridge shingle includes a base layer and a dimensional layer affixed to the base layer by an adhesive line that extends in the machine direction and along the width of the base and the dimensional layers. Sealant that comprises at least two parallel lines of sealant material that extend in the machine direction of the base and dimensional layers is disposed on a bottom surface of the base layer for adhering the hip and ridge shingle to an underlying hip and ridge shingle. Another hip and ridge shingle, which may be single layer or laminated, includes a granule coated asphalt substrate, sealant on the substrate, and release tape on the substrate. The sealant comprises at least two parallel lines of sealant material that extend in a direction of a width of the substrate for adhering the hip and ridge shingle to an underlying hip and ridge shingle. The release tape is disposed on a bottom of the substrate and is alignable with the at least two parallel lines of sealant when two of the hip and ridge shingles are stacked to prevent the two hip and ridge shingles from sticking together.

17 Claims, 18 Drawing Sheets

(56) References Cited

U.S. PATENT DOCUMENTS

| | | | |
|---|---|---|---|
| D48,172 | S | 11/1915 | Dun Lany |
| 1,447,750 | A | 3/1923 | Bird |
| 1,495,070 | A | 5/1924 | Finley |
| 1,516,243 | A | 11/1924 | Perry |
| 1,549,723 | A | 8/1925 | Mattison |
| 1,583,563 | A | 5/1926 | Abraham |
| 1,585,693 | A | 5/1926 | Robinson |
| 1,597,135 | A | 8/1926 | Wittenberg |
| 1,601,731 | A | 10/1926 | Flood |
| 1,665,222 | A | 4/1928 | Robinson |
| 1,666,429 | A | 4/1928 | Stolp, Jr. |
| 1,676,351 | A | 7/1928 | Robinson |
| 1,698,891 | A | 1/1929 | Overbury |
| 1,701,926 | A | 2/1929 | Kirschbraun |
| 1,799,500 | A | 4/1931 | Brophy |
| 1,802,868 | A | 4/1931 | Roscoe |
| 1,843,370 | A | 2/1932 | Overbury |
| 1,860,899 | A | 5/1932 | Denton |
| 1,885,346 | A | 11/1932 | Harshberger |
| 1,897,139 | A | 2/1933 | Overbury |
| 1,898,989 | A | 2/1933 | Harshberger |
| 1,964,529 | A | 12/1934 | Harshberger |
| 2,058,167 | A | 10/1936 | McQuade |
| 2,161,440 | A | 6/1939 | Venrick |
| 2,490,430 | A | 12/1949 | Greider et al. |
| 2,798,006 | A | 7/1957 | Oldfield et al. |
| 2,847,948 | A | 8/1958 | Truitt |
| 3,054,222 | A | 9/1962 | Buckner |
| 3,127,701 | A | 4/1964 | Jastrzemski |
| 3,138,897 | A | 6/1964 | McCorkle |
| 3,252,257 | A | 5/1966 | Price et al. |
| 3,332,830 | A | 7/1967 | Tomlinson et al. |
| 3,377,762 | A | 4/1968 | Chalmers |
| 3,468,086 | A | 9/1969 | Warner |
| 3,468,092 | A | 9/1969 | Chalmers |
| 3,624,975 | A | 12/1971 | Morgan et al. |
| 3,664,081 | A | 5/1972 | Martin et al. |
| 3,813,280 | A | 5/1974 | Olszeyk et al. |
| 154,334 | A | 8/1974 | Overbury |
| 3,913,294 | A | 10/1975 | Freiborg |
| 4,091,135 | A | 5/1978 | Tajima et al. |
| 4,194,335 | A | 3/1980 | Diamond |
| 4,195,461 | A | 4/1980 | Thiis-Evensen |
| 4,274,243 | A | 6/1981 | Corbin et al. |
| 4,301,633 | A | 11/1981 | Neumann |
| 4,307,552 | A | 12/1981 | Votte |
| 4,333,279 | A | 6/1982 | Corbin et al. |
| D265,510 | S | 7/1982 | Bedwell, Jr. |
| 4,352,837 | A | 10/1982 | Kopenhaver |
| 4,366,197 | A | 12/1982 | Hanlon et al. |
| 4,404,783 | A | 9/1983 | Freiborg |
| 4,434,589 | A | 3/1984 | Freiborg |
| 4,439,955 | A | 4/1984 | Freiborg |
| 4,459,157 | A | 7/1984 | Koons |
| 4,527,374 | A | 7/1985 | Corbin |
| 4,580,389 | A | 4/1986 | Freiborg |
| 4,637,191 | A | 1/1987 | Smith |
| 4,672,790 | A | 6/1987 | Freiborg |
| 4,680,909 | A | 7/1987 | Stewart |
| 4,706,435 | A | 11/1987 | Stewart |
| 4,717,614 | A | 1/1988 | Bondoc et al. |
| 4,738,884 | A | 4/1988 | Algrim et al. |
| 4,755,545 | A | 7/1988 | Lalwani |
| 4,789,066 | A | 12/1988 | Lisiecki |
| D300,257 | S | 3/1989 | Stahl |
| 4,817,358 | A | 4/1989 | Lincoln et al. |
| 4,824,880 | A | 4/1989 | Algrim et al. |
| 4,835,929 | A | 6/1989 | Bondoc et al. |
| 4,848,057 | A | 7/1989 | MacDonald et al. |
| 4,856,251 | A | 8/1989 | Buck |
| 4,869,942 | A | 9/1989 | Jennus et al. |
| D309,027 | S | 7/1990 | Noone et al. |
| D313,278 | S | 12/1990 | Noone |
| 5,036,119 | A | 7/1991 | Berggren |
| 5,039,755 | A | 8/1991 | Chamberlain et al. |
| 5,065,553 | A | 11/1991 | Magid |
| 5,082,704 | A | 1/1992 | Higgins |
| 5,094,042 | A | 3/1992 | Freiborg |
| 5,181,361 | A | 1/1993 | Hannah et al. |
| 5,195,290 | A | 3/1993 | Hulett |
| 5,209,802 | A | 5/1993 | Hannah et al. |
| 5,232,530 | A | 8/1993 | Malmquist et al. |
| 5,239,802 | A | 8/1993 | Robinson |
| 5,247,771 | A | 9/1993 | Poplin |
| D340,294 | S | 10/1993 | Hannah et al. |
| 5,271,201 | A | 12/1993 | Noone et al. |
| 5,295,340 | A | 3/1994 | Collins |
| D347,900 | S | 6/1994 | Stapleton |
| 5,319,898 | A | 6/1994 | Freiborg |
| 5,365,711 | A | 11/1994 | Pressutti et al. |
| 5,369,929 | A | 12/1994 | Weaver et al. |
| 5,375,387 | A | 12/1994 | Davenport |
| 5,375,388 | A | 12/1994 | Poplin |
| 5,400,558 | A | 3/1995 | Hannah et al. |
| 5,419,941 | A | 5/1995 | Noone et al. |
| 5,426,902 | A | 6/1995 | Stahl et al. |
| 5,467,568 | A | 11/1995 | Sieling |
| 5,471,801 | A | 12/1995 | Kupczyk et al. |
| D366,124 | S | 1/1996 | Hannah et al. |
| 5,488,807 | A | 2/1996 | Terrenzio et al. |
| D369,421 | S | 4/1996 | Kiik et al. |
| D375,563 | S | 11/1996 | Hannah et al. |
| 5,570,556 | A | 11/1996 | Wagner |
| 5,571,596 | A | 11/1996 | Johnson |
| 5,575,876 | A | 11/1996 | Noone et al. |
| 5,577,361 | A | 11/1996 | Grabek, Jr. |
| D376,660 | S | 12/1996 | Hannah et al. |
| 5,611,186 | A | 3/1997 | Weaver |
| 5,615,523 | A | 4/1997 | Wells et al. |
| 5,624,522 | A | 4/1997 | Belt et al. |
| D379,672 | S | 6/1997 | Lamb et al. |
| 5,651,734 | A | 7/1997 | Morris |
| 5,660,014 | A | 8/1997 | Stahl et al. |
| D383,223 | S | 9/1997 | Sieling et al. |
| 5,664,385 | A | 9/1997 | Koschitzky |
| 5,666,776 | A | 9/1997 | Weaver et al. |
| 5,676,597 | A | 10/1997 | Bettoli et al. |
| 5,711,126 | A | 1/1998 | Wells et al. |
| 5,746,830 | A | 5/1998 | Burton |
| 5,795,389 | A | 8/1998 | Koschitzky |
| 5,799,459 | A | 9/1998 | Covert |
| D400,268 | S | 10/1998 | Sieling et al. |
| 5,822,943 | A | 10/1998 | Frankoski et al. |
| D400,981 | S | 11/1998 | Bondoc et al. |
| D403,087 | S | 12/1998 | Sieling et al. |
| 5,853,858 | A | 12/1998 | Bondoc |
| 5,860,263 | A | 1/1999 | Sieling et al. |
| D406,361 | S | 3/1999 | Bondoc et al. |
| 5,901,517 | A | 5/1999 | Stahl et al. |
| 5,916,103 | A | 6/1999 | Roberts |
| 5,939,169 | A | 8/1999 | Bondoc et al. |
| 5,950,387 | A | 9/1999 | Stahl et al. |
| D417,016 | S | 11/1999 | Moore et al. |
| D417,513 | S | 12/1999 | Blanpied |
| 6,010,589 | A | 1/2000 | Stahl et al. |
| 6,014,847 | A | 1/2000 | Phillips |
| 6,021,611 | A | 2/2000 | Wells et al. |
| 6,038,826 | A | 3/2000 | Stahl et al. |
| 6,044,608 | A | 4/2000 | Stahl et al. |
| 6,070,384 | A | 6/2000 | Chich |
| 6,083,592 | A | 7/2000 | Chich |
| 6,105,329 | A | 8/2000 | Bondoc et al. |
| RE36,858 | E | 9/2000 | Presutti et al. |
| 6,112,492 | A | 9/2000 | Wells et al. |
| 6,125,602 | A | 10/2000 | Freiborg et al. |
| 6,145,265 | A | 11/2000 | Malarkey et al. |
| 6,148,578 | A | 11/2000 | Nowacek et al. |
| 6,156,289 | A | 12/2000 | Chopra |
| 6,182,400 | B1 | 2/2001 | Freiborg et al. |
| 6,185,895 | B1 | 2/2001 | Rettew |
| 6,190,754 | B1 | 2/2001 | Bondoc et al. |
| 6,199,338 | B1 | 3/2001 | Hudson, Jr. et al. |
| 6,220,329 | B1 | 4/2001 | King et al. |
| 6,247,289 | B1 | 6/2001 | Karpinia |

(56) References Cited

U.S. PATENT DOCUMENTS 6,253,512 B1 7/2001 Thompson et al.
6,310,122 B1 10/2001 Butler et al.
6,343,447 B2 2/2002 Geissels et al.
6,351,913 B1 3/2002 Freiborg et al.
6,355,132 B1 3/2002 Becker et al.
6,361,851 B1 3/2002 Sieling et al.
6,397,546 B1 6/2002 Malarkey et al.
6,397,556 B1 6/2002 Karpinia
6,401,425 B1 6/2002 Frame
6,426,309 B1 7/2002 Miller et al.
6,467,235 B2 10/2002 Kalkanoglu et al.
6,471,812 B1 10/2002 Thompson et al.
D466,629 S 12/2002 Phillips
6,487,828 B1 12/2002 Phillips
6,494,010 B1 12/2002 Brandon et al.
6,510,664 B2 1/2003 Kupczyk
6,523,316 B2 2/2003 Stahl et al.
6,530,189 B2 3/2003 Freshwater et al.
D473,326 S 4/2003 Phillips
6,565,431 B1 5/2003 Villela
6,578,336 B2 6/2003 Elliott
6,610,147 B2 8/2003 Aschenbeck
6,652,909 B2 11/2003 Lassiter
6,679,020 B2 1/2004 Becker et al.
6,679,308 B2 1/2004 Becker et al.
6,691,489 B2 2/2004 Frame
6,703,120 B1 3/2004 Ko
6,708,456 B2 3/2004 Kiik et al.
6,709,760 B2 3/2004 Trumbore et al.
6,709,994 B2 3/2004 Miller et al.
6,725,609 B2 4/2004 Freiborg et al.
6,758,019 B2 7/2004 Kalkanoglu et al.
6,759,454 B2 7/2004 Stephens et al.
6,790,307 B2 9/2004 Elliott
6,804,919 B2 10/2004 Railkar
6,813,866 B2 11/2004 Naipawer, III
6,823,637 B2 11/2004 Elliott et al.
6,895,724 B2 5/2005 Naipawer, III
6,933,037 B2 8/2005 McCumber et al.
6,936,329 B2 8/2005 Kiik et al.
6,990,779 B2 1/2006 Kiik et al.
7,021,468 B2 4/2006 Cargile, Jr.
7,029,739 B2 4/2006 Weinstein et al.
7,048,990 B2 5/2006 Kochitzky
7,070,051 B2 7/2006 Kanner et al.
7,073,295 B2 7/2006 Pressutti et al.
7,082,724 B2 8/2006 Railkar et al.
7,118,794 B2 10/2006 Kalkanoglu et al.
7,121,055 B2 10/2006 Penner
7,124,548 B2 10/2006 Pressutti et al.
7,146,771 B2 12/2006 Swann
7,165,363 B2 1/2007 Headrick et al.
7,238,408 B2 7/2007 Aschenbeck et al.
7,267,862 B1 9/2007 Burke et al.
7,282,536 B2 10/2007 Handlin et al.
7,556,849 B2 7/2009 Thompson et al.
D610,720 S 2/2010 Elliott
7,765,763 B2 8/2010 Teng et al.
7,781,046 B2 8/2010 Kalkanoglu et al.
7,805,905 B2 10/2010 Rodrigues et al.
7,820,237 B2 10/2010 Harrington, Jr.
7,836,654 B2 11/2010 Belt et al.
D633,221 S 2/2011 Koch
D633,222 S 2/2011 Koch
7,877,949 B1 2/2011 Elliott
7,909,235 B2 3/2011 Holley, Jr.
7,921,606 B2 4/2011 Quaranta et al.
8,006,457 B2 8/2011 Binkley et al.
8,127,514 B2 3/2012 Binkley et al.
8,181,413 B2 5/2012 Belt et al.
8,216,407 B2 7/2012 Kalkanoglu et al.
8,240,102 B2 8/2012 Belt et al.
8,266,861 B2 9/2012 Koch et al.
8,281,520 B2 10/2012 Quaranta et al.
8,281,539 B2 10/2012 Kalkanoglu
8,302,358 B2 11/2012 Kalkanoglu
8,316,608 B2 11/2012 Binkley et al.
8,323,440 B2 12/2012 Koch
8,371,072 B1 2/2013 Shanes et al.
8,371,085 B2 2/2013 Koch
8,453,408 B2 6/2013 Kalkanoglu et al.
D695,925 S 12/2013 Ray
D711,558 S 8/2014 Bobolts
D735,545 S 8/2015 Rampling
2001/0000372 A1 4/2001 Kalkanoglu et al.
2001/0049002 A1 12/2001 McCumber et al.
2002/0000068 A1 1/2002 Freiborg et al.
2002/0038531 A1 4/2002 Freshwater et al.
2002/0078651 A1 6/2002 Freshwater et al.
2002/0114913 A1 8/2002 Weinstein et al.
2003/0040241 A1 2/2003 Kiik et al.
2003/0070579 A1 4/2003 Hong et al.
2003/0093958 A1 5/2003 Freiborg et al.
2003/0093963 A1 5/2003 Stahl et al.
2003/0124292 A1 7/2003 Unterreiter
2003/0138601 A1 7/2003 Elliott
2003/0196389 A1* 10/2003 Naipawer, III ..... E04D 1/22 52/57
2004/0055240 A1 3/2004 Kiik et al.
2004/0055241 A1 3/2004 Railkar
2004/0079042 A1 4/2004 Elliott
2004/0083672 A1 5/2004 Penner
2004/0083673 A1 5/2004 Kalkanoglu et al.
2004/0083674 A1 5/2004 Kalkanoglu et al.
2004/0109971 A1 6/2004 Weinstein et al.
2004/0111996 A1 6/2004 Heronome
2004/0123537 A1 7/2004 Elliott et al.
2004/0123543 A1 7/2004 Elliott et al.
2004/0148874 A1 8/2004 Jolitz et al.
2004/0172908 A1 9/2004 Swann
2004/0206012 A1 10/2004 Pressutti et al.
2004/0206035 A1 10/2004 Kandalgaonkar
2004/0258883 A1 12/2004 Weaver
2005/0005555 A1 1/2005 Naipawer
2005/0137295 A1 6/2005 Kendrick et al.
2005/0193673 A1 9/2005 Rodrigues et al.
2005/0204675 A1 9/2005 Snyder et al.
2005/0210808 A1 9/2005 Larson et al.
2005/0235599 A1 10/2005 Kalkanoglu et al.
2005/0252136 A1 11/2005 Hardin
2006/0032174 A1 2/2006 Floyd
2006/0175386 A1 8/2006 Holley, Jr.
2006/0179767 A1 8/2006 Miller et al.
2006/0201094 A1 9/2006 Lassiter
2006/0265990 A1 11/2006 Kalkanoglu et al.
2007/0020436 A1 1/2007 Teng et al.
2007/0039274 A1 2/2007 Harrington et al.
2007/0042158 A1 2/2007 Belt et al.
2007/0107372 A1 5/2007 Harrington, Jr.
2007/0144077 A1 6/2007 Quaranta et al.
2007/0179220 A1 8/2007 Sasagawa et al.
2007/0266665 A1 11/2007 Todd et al.
2008/0134612 A1 6/2008 Koschitzky
2009/0038257 A1 2/2009 Todd et al.
2009/0139175 A1 6/2009 Todd et al.
2009/0282767 A1 11/2009 Grubka
2010/0077689 A1 4/2010 Kalkanoglu et al.
2010/0143667 A1 6/2010 Collins et al.
2010/0192496 A1 8/2010 Koch et al.
2010/0192500 A1 8/2010 Koch
2010/0192501 A1* 8/2010 Koch ..... E04D 1/20 52/557
2010/0212240 A1 8/2010 Grubka
2010/0212246 A1 8/2010 Grubka
2010/0218433 A1 9/2010 Quaranta et al.
2010/0236178 A1 9/2010 Loftus
2010/0239807 A1 9/2010 Grubka
2010/0310825 A1 12/2010 Kalkanoglu et al.
2010/0313512 A1 12/2010 Rodrigues et al.
2011/0005158 A1 1/2011 Kailey et al.
2011/0126485 A1 6/2011 Bliel et al.
2011/0151170 A1 6/2011 Grubka et al.
2011/0209428 A1 9/2011 Elliott

(56) References Cited

U.S. PATENT DOCUMENTS

| | | | |
|---|---|---|---|
| 2011/0214378 | A1 | 9/2011 | Grubka |
| 2011/0319533 | A1 | 12/2011 | Gauthier et al. |
| 2013/0177728 | A1 | 7/2013 | Grubka et al. |

FOREIGN PATENT DOCUMENTS

| | | |
|---|---|---|
| CN | 2176391 | 9/1994 |
| JP | 50002937 | 1/1975 |
| WO | 2005/100479 | 10/2005 |
| WO | 2007/108846 | 9/2007 |
| WO | 2008/052029 | 5/2008 |
| WO | 2009/016281 | 2/2009 |
| WO | 2010/098972 | 9/2010 |
| WO | 2011/100217 | 8/2011 |

OTHER PUBLICATIONS

Office action from U.S. Appl. No. 13/344,025 dated Sep. 24, 2014.
Interview Summary from U.S. Appl. No. 12/727,459 dated Aug. 19, 2014.
Interview Summary from U.S. Appl. No. 12/702,457 dated Jul. 31, 2014.
Advisory Action from U.S. Appl. No. 12/702,457 dated Aug. 27, 2014.
Office action from U.S. Appl. No. 13/039,726 dated Aug. 14, 2014.
Interview Summary from U.S. Appl. No. 13/344,025 dated Jul. 30, 2014.
Office action from U.S. Appl. No. 12/702,457 dated Dec. 3, 2014.
Advisory Action from U.S. Appl. No. 13/039,726 dated Oct. 28, 2014.
Notice of Allowance from U.S. Appl. No. 13/039,726 dated Jan. 22, 2015.
Office action from U.S. Appl. No. 12/727,459 dated Jan. 26, 2015.
Office action from U.S. Appl. No. 12/717,519 dated Dec. 12, 2014.
Office action from U.S. Appl. No. 13/344,025 dated Feb. 26, 2015.
Interview Summary from U.S. Appl. No. 12/702,457 dated Mar. 4, 2015.
Notice of Allowance from U.S. Appl. No. 12/717,519 dated Apr. 2, 2015.
Notice of Allowance from U.S. Appl. No. 12/702,457 dated May 26, 2015.
Office action from U.S. Appl. No. 12/727,470 dated May 26, 2015.
Interview Summary from U.S. Appl. No. 13/344,025 dated May 21, 2015.
Office action from U.S. Appl. No. 29/483,307 dated Sep. 15, 2015.
Notice of Allowance from U.S. Appl. No. 13/344,025 dated Nov. 6, 2015.
Supplemental Allowance from U.S. Appl. No. 13/344,025 dated Nov. 23, 2015.
Office action from Canadian Application No. 2,697,223 dated Jan. 12, 2016.
Office action from U.S. Appl. No. 12/727,470 dated Feb. 11, 2016.
Office action from Canadian Application No. 2,697,221 dated Feb. 2, 2016.
Office action from Canadian Application No. 2,753,250 dated Nov. 26, 2015.
Notice of Allowance from U.S. Appl. No. 29/483,307 dated Feb. 11, 2016.
Notice of Allowance from U.S. Appl. No. 14/751,334 dated Apr. 8, 2016.
Office action from Canadian Application No. 2,753,250 dated Aug. 19, 2016.
Office action from Canadian Application No. 2,697,223 dated Aug. 25, 2016.
Notice of Allowance from U.S. Appl. No. 12/727,470 dated Oct. 7, 2016.
Office action from U.S. Appl. No. Dec. 12/7171,519 dated Jun. 12, 2014.
Office action from U.S. Appl. No. 12/702,457 daetd May 7, 2014.
Office action from U.S. Appl. No. 12/727,459 dated May 25, 2011.
Office action from U.S. Appl. No. 12/727,459 dated Aug. 30, 2011.
Interview Summary from U.S. Appl. No. 12/727,459 dated Dec. 28, 2011.
Office action from U.S. Appl. No. 12/727,459 dated Jan. 19, 2012.
Interview Summary from U.S. Appl. No. 12/727,459 dated Apr. 13, 2012.
Office action from U.S. Appl. No. 12/727,459 dated May 30, 2012.
Office action from U.S. Appl. No. 12/727,459 dated Oct. 3, 2012.
Advisory action from U.S. Appl. No. 12/727,459 dated Dec. 13, 2012.
Office action from U.S. Appl. No. 12/727,459 dated Jul. 11, 2013.
Office action from U.S. Appl. No. 12/727,459 dated Jan. 10, 2014.
Office action from U.S. Appl. No. 12/727,470 dated Aug. 10, 2012.
Office action from U.S. Appl. No. 12/727,470 dated Apr. 10, 2013.
Office action from U.S. Appl. No. 12/831,130 dated Feb. 29, 2012.
Office action from U.S. Appl. No. 12/831,130 dated Jun. 14, 2012.
Office action from U.S. Appl. No. 12/831,130 dated Aug. 9, 2012.
Office action from U.S. Appl. No. 13/019,028 dated Aug. 10, 2011.
Office action from U.S. Appl. No. 13/019,028 dated Jun. 21, 2012.
Office action from U.S. Appl. No. 13/019,028 dated Dec. 19, 2012.
Office action from U.S. Appl. No. 13/039,726 dated Feb. 5, 2014.
Office action from U.S. Appl. No. 13/193,864 dated May 15, 2013.
Office action from U.S. Appl. No. 13/193,864 dated Nov. 4, 2013.
Office action from U.S. Appl. No. 13/344,025 dated Feb. 5, 2013
Office action from U.S. Appl. No. 13/344,025 dated Aug. 16, 2013.
Office action from U.S. Appl. No. 13/344,025 dated Mar. 27, 2014.
Office action from Chinese application No. 200680028893.4 dated Mar. 27, 2009.
Office action from Japanese Application No. 2008-525265 dated Dec. 12, 2011.
Haynes, Shellflex 3681 MSDS, Jan. 4, 1999, 5 pgs.
International Search Report from PCT/US06/30633 dated Nov. 28, 2006.
International Search Report and Written Opinion from PCT/US07/07827 dated Aug. 29, 2007.
International Search Report and Written Opinion from PCT/US10/23541 dated Jul. 6, 2010.
International Search Report and Written Opinion from PCT/US11/023989 dated May 26, 2011.
Office action from U.S. Appl. No. 09/515,928 dated Mar. 15, 2001.
Office action from U.S. Appl. No. 09/515,928 dated Oct. 11, 2001.
Office action from U.S. Appl. No. 09/515,928 dated Jan. 2, 2002.
Advisory action from U.S. Appl. No. 09/515,928 dated Jun. 7, 2002.
Office action from U.S. Appl. No. 09/515,928 dated Sep. 16, 2004.
Advisory action from U.S. Appl. No. 09/515,928 dated Feb. 22, 2005.
Office action from U.S. Appl. No. 09/515,928 dated Dec. 2, 2005.
Office action from U.S. Appl. No. 09/515,928 dated Apr. 25, 2006.
Office action from U.S. Appl. No. 09/515,928 dated Oct. 11, 2006.
Office action from U.S. Appl. No. 09/515,928 dated Apr. 10, 2007.
Advisory action from U.S. Appl. No. 09/515,928 dated Jul. 19, 2007.
Office action from U.S. Appl. No. 09/515,928 dated Sep. 19, 2007.
Notice of Panel Decision from Pre-Appeal Brief Review from U.S. Appl. No. 09/515,928 dated Feb. 8, 2008.
Examiner's Answer from U.S. Appl. No. 09/515,928 dated Jun. 18, 2008.
Decision on Appeal from U.S. Appl. No. 09/515,928 dated Jul. 28, 2010.
Notice of Allowance from U.S. Appl. No. 09/515,928 dated Sep. 27, 2010.
Office action from U.S. Appl. No. 12/119,937 dated Apr. 14, 2010.
Office action from U.S. Appl. No. 12/119,937 dated Nov. 4, 2010.
Advisory action from U.S. Appl. No. 12/119,937 dated Jan. 19, 2011.
Office action from U.S. Appl. No. 12/119,937 dated Apr. 3, 2012.
Office action from U.S. Appl. No. 12/392,392 dated Mar. 4, 2010.
Office action from U.S. Appl. No. 12/392,392 dated Sep. 13, 2010.
Advisory Action from U.S. Appl. No. 12/392,392 dated Dec. 14, 2010.
Office action from U.S. Appl. No. 12/392,392 dated Dec. 22, 2010.

(56) References Cited

OTHER PUBLICATIONS

Interview Summary from U.S. Appl. No. 12/392,392 dated Feb. 3, 2011.
Office action from U.S. Appl. No. 12/392,392 dated Aug. 18, 2011.
Office action from U.S. Appl. No. 12/392,392 dated Nov. 21, 2011.
Advisory Action from U.S. Appl. No. 12/392,392 dated Feb. 27, 2012.
Office action from U.S. Appl. No. 12/392,392 dated Jun. 14, 2012.
Office action from U.S. Appl. No. 12/392,392 dated Jul. 19, 2012.
Office action from U.S. Appl. No. 12/702,457 dated Jun. 18, 2012.
Office action from U.S. Appl. No. 12/702,457 dated Jul. 20, 2012.
Office action from U.S. Appl. No. 12/702,457 dated Nov. 21, 2013.
Interview Summary from U.S. Appl. No. 12/702,457 dated Feb. 26, 2014.
Office action from U.S. Appl. No. 12/717,519 dated Oct. 3, 2011.
Office action from U.S. Appl. No. 12/717,519 dated May 1, 2012.
Correct Notice of Allowance from U.S. Appl. No. 12/727,470 dated Oct. 28, 2016.
Notice of Allowance from U.S. Appl. No. 12/751,334 dated Aug. 5, 2016.
Office action from Canadian Application No. 2,788,522, dated Jan. 11, 2017, dated May 2, 2017.
Office action from Canadian Application No. 2,729,373 dated Dec. 20, 2016, dated Feb. 9, 2017.
Office action from U.S. Appl. No. 15/397,850 dated Mar. 24, 2017.
Office action from U.S. Appl. No. 15/397,850 dated Jul. 27, 2017.

* cited by examiner

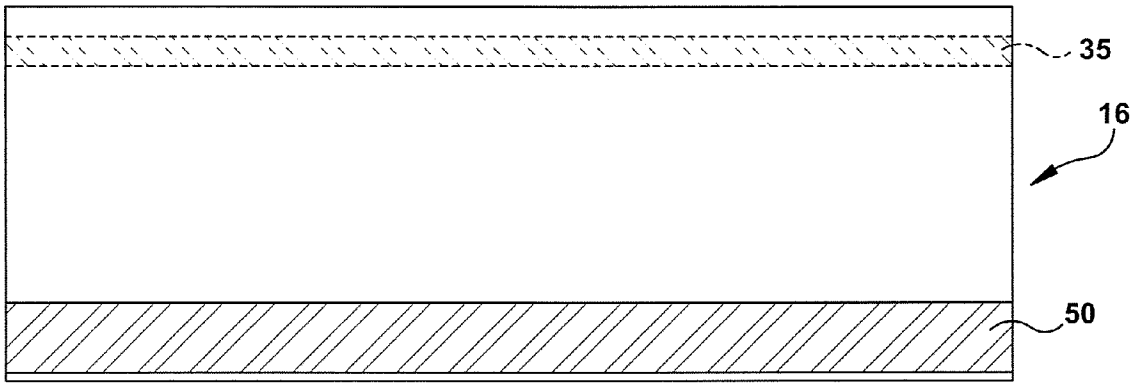
Fig. 17
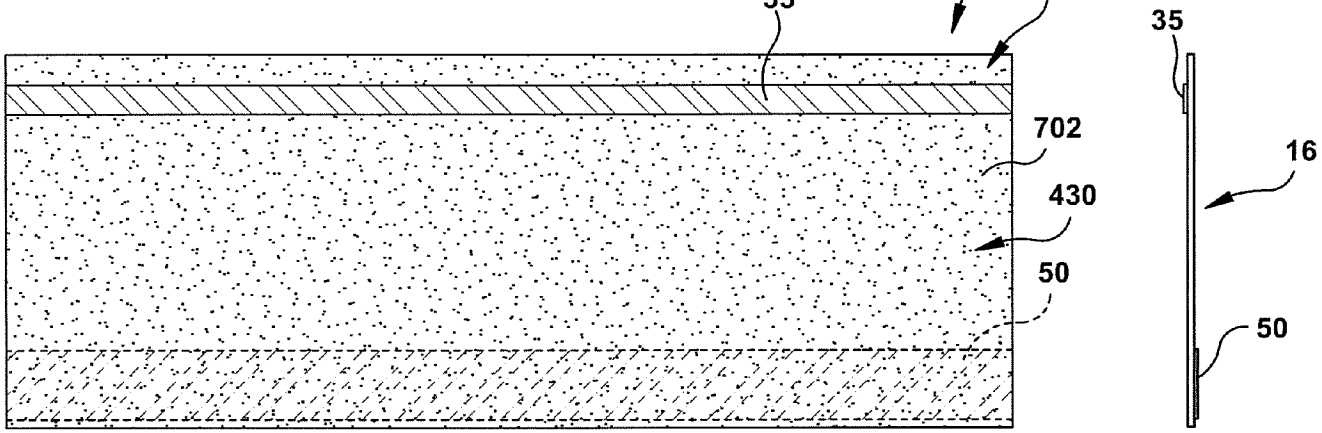
Fig. 15
Fig. 16

LAMINATED HIP AND RIDGE SHINGLE

FIELD OF THE INVENTION

The present invention relates generally to roofing shingles, and more particularly, to multi-layered shingles that are configured to permit the shingle to be bent, such as over an apex of a roof.

BACKGROUND

Roofs are typically formed so as to present at least two non-parallel planes that meet at a peak, usually the uppermost point of the roof. This peak is typically referred to as the ridge. Roofs can also be formed to present other non-parallel planes that are often formed at the ends of the ridge to form other diagonally-extending plane intersections similar to the ridge, but are referred to as hips. Whereas, the covering of the planar portions of a roof typically involve the laying of shingles in overlapping, transversely parallel courses from the bottom roof edge to the ridge or hip, the ridges and hips require a different technique to cover the intersection of the two or more roof planes. A conventional technique for covering the ridges and hips is to cut the shingles into appropriate width and to bend the cut shingle over the ridge or hip so as to overlap the shingles placed on the opposing roof planes, and then starting at one end of the ridge or hip and overlap the cut shingles along the length of the ridge or hip.

Asphalt composite shingles are one of the most commonly used roofing products. These asphalt composite shingles typically incorporate a base material made from a fiberglass mat, or other suitable reinforcement member, such as an organic felt material. This reinforcing base material serves as a matrix to support an asphalt coating and gives the shingle strength. The asphalt coating is formulated for the particular service application and has a long-term ability to resist weathering and provide stability for the structure under extreme temperature conditions. An outer layer of granules is applied to the asphalt coating to form an outer surface that the asphalt coating from direct sunlight. Utilizing differently colored granules provides a variety in the surface appearance of the shingle to establish color variations.

Conventional laminated shingles, for example, as well as hip and ridge shingles, are generally multilayered and the separate, individual layers are held together with an adhesive material.

SUMMARY

Hip and ridge shingles are disclosed by the present patent application. The hip and ridge shingles may be single layer or laminated (i.e. more than one layer adhered on top of one another). In one exemplary embodiment, a laminated hip and ridge shingle includes a base layer and a dimensional layer. The dimensional layer is affixed to the base layer by an adhesive line that extends in the machine direction and along the width of the base and the dimensional layers. The adhesive line is disposed on only one lateral side of the base layer and dimensional layers to allow movement of another lateral side of the dimensional layer relative to the base layer.

In one exemplary embodiment, a laminated hip and ridge shingle includes a base layer and a dimensional layer. The dimensional layer is affixed to the base layer by an adhesive line that extends in the machine direction and along the width of the base and the dimensional layers. Sealant that comprises one line or two or more parallel lines of sealant material that extend in the machine direction of the base and dimensional layers is disposed on a bottom surface of the base layer for adhering the hip and ridge shingle to an underlying hip and ridge shingle.

In one exemplary embodiment, a hip and ridge shingle includes a granule coated asphalt substrate, sealant on the substrate, and release tape on the substrate. The sealant comprises one line or two or more parallel lines of sealant material that extend in a direction of a width of the substrate for adhering the hip and ridge shingle to an underlying hip and ridge shingle. The release tape is disposed on a bottom of the substrate that is alignable with the at least two parallel lines of sealant when two of the hip and ridge shingles are stacked to prevent the two hip and ridge shingles from sticking together.

BRIEF DESCRIPTION OF THE DRAWINGS

In the accompanying drawings which are incorporated in and constitute a part of the specification, embodiments of the invention are illustrated, which together with a general description of the invention given above and the detailed description given below, serve to example the principles of this invention.

FIG. 15 illustrates a single one-layer shingle that can be used to make three of the laminated hip and ridge shingles illustrated by FIG. 12;

FIG. 16 is a side view of the shingle illustrated by FIG. 15;

FIG. 17 is a top view of the shingle illustrated by FIG. 15;

DETAILED DESCRIPTION

Figure 1:
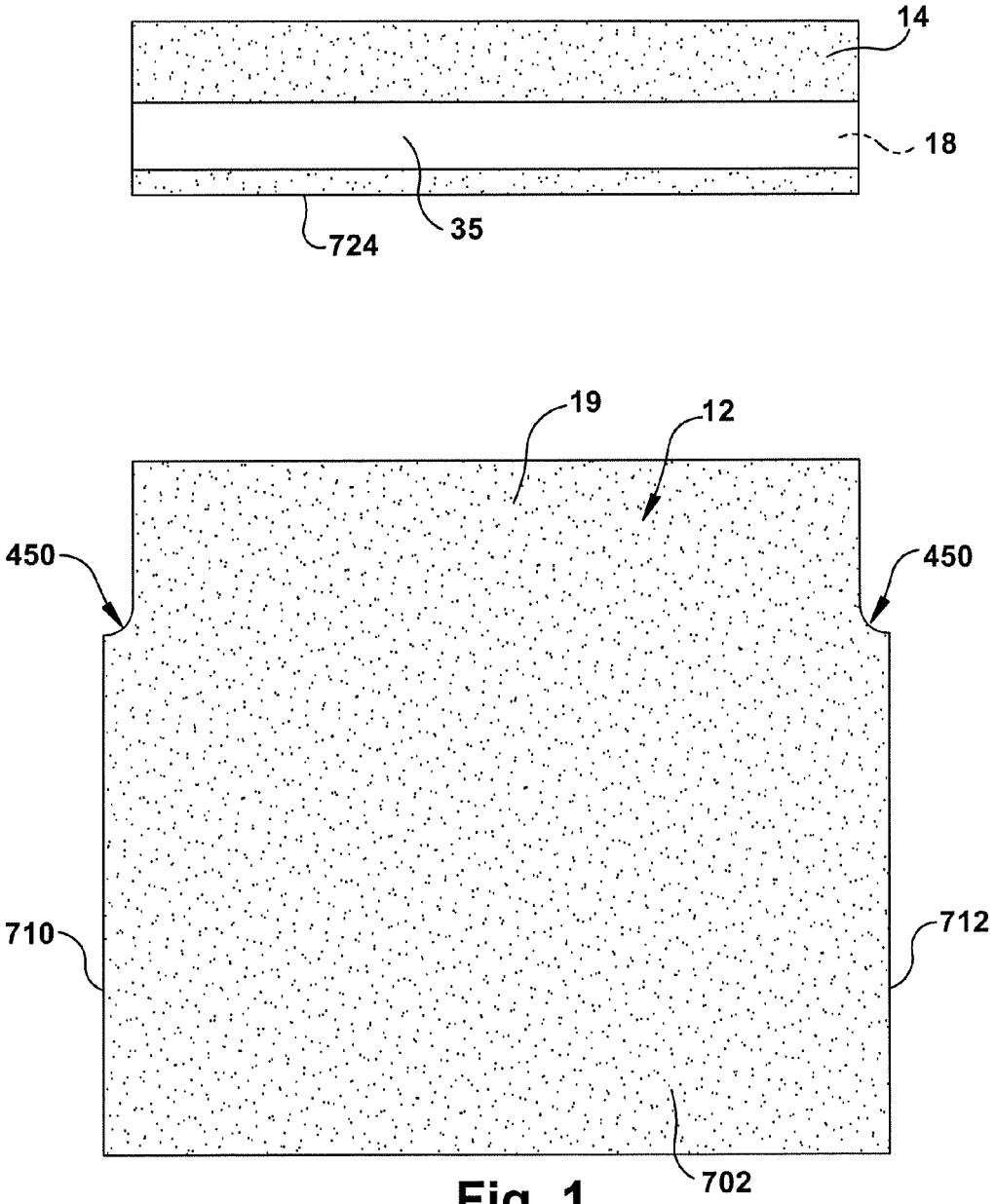
FIG. 1 illustrates a base layer and a dimensional layer that are assembled to form a laminated hip and ridge shingle.

Unless defined otherwise, all technical and scientific terms used herein have the same meaning as commonly understood by one of ordinary skill in the art to which the invention belongs. All references cited herein, including published or corresponding U.S. or foreign patent applications, issued U.S. or foreign patents, or any other references, are each incorporated by reference in their entireties, including all data, tables, figures, and text presented in the cited references. The terms "cap shingle", "cap", or "hip and ridge shingle" may be used interchangeably herein.

The description and drawings disclose exemplary embodiments of hip and ridge shingles 10. With reference to FIG. 1A, a building structure 110 is shown having a shingle-based roofing system 112. While the building structure 110 illustrated in FIG. 1A is a residential home, it should be understood that the building structure 110 can be any type of structure, such as a garage, church, arena or commercial building, having a shingle-based roofing system 112.

The building structure 110 has a plurality of roof planes 114*a*-114*d*. The term "roof plane" as used herein is defined to mean a plane defined by a flat portion of the roof formed by an area of roof deck. Each of the roof planes 114*a*-114*d* has a slope. The term "slope" as used herein is defined to mean the degree of incline of the roof plane. While the roof planes 114*a*-114*d* shown in FIG. 1A have their respective illustrated slopes, it should be understood that the roof planes 114*a*-114*d* can have any suitable slope. The intersection of the roof planes 114*b* and 114*c* form a hip 116. The term "hip" as used herein is defined to mean the inclined external angle formed by the intersection of two sloping roof planes. Similarly, the intersection of the roof planes 114*b* and 114*d* form a ridge 118. The term "ridge" as used herein is defined to mean the uppermost horizontal external angle formed by the intersection of two sloping roof planes.

The building structure 110 is covered by the roofing system 112 having a plurality of shingles 120. In the illustrated embodiment, the shingles 120 may be asphalt-based roofing material of the type disclosed in U.S. Pat. No. 6,709,994 to Miller et al., which is incorporated by reference, in its entirety. As shown in FIG. 1B, the shingles 120 are installed on the various roof decks in generally horizontal courses 122*a*-122*g* in which the shingles 120 overlap the shingles of a preceding course.

Hip and ridge shingles 10 are installed to protect hips and ridges from the elements. As shown in FIG. 1B, hip and ridge shingles 10 are installed on the ridge 118 and over the shingles 120. In a similar fashion, hip and ridge shingles are installed on a hip (not shown) and over the shingles.

Figure 1A:
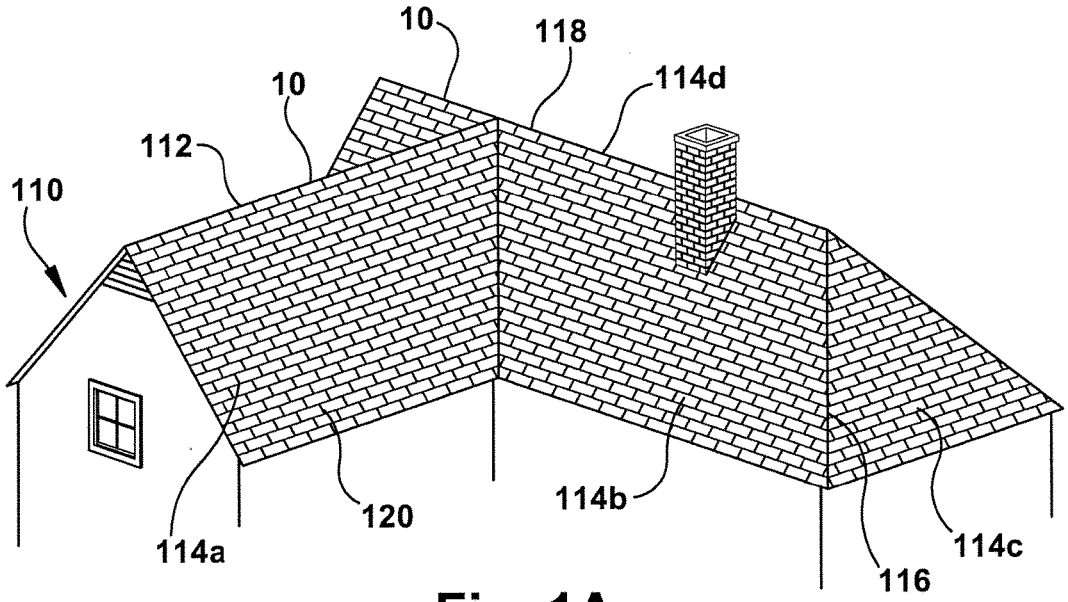
FIG. 1A is a perspective view of a roof.
Figure 1B:
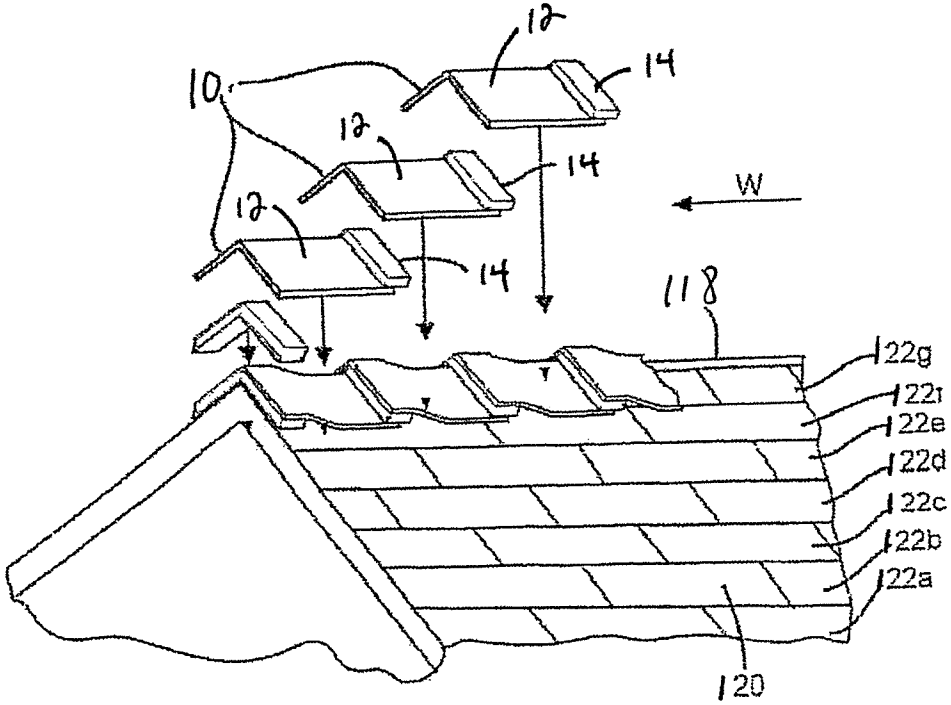
FIG. 1B is a perspective view of a hip or ridge of a roof illustrating hip and ridge shingles being installed.

Referring to FIG. 1, an exemplary embodiment of a laminated hip and ridge shingle 10 is shown. The laminated shingle 10 includes a base layer 12 and a dimensional layer 14. The base layer 12 and the dimensional layer 14 can be made in a wide variety of different ways. For example, each of the layers can be made in the same manner that conventional single layer shingles are made. That is, asphalt is applied to a fiberglass mat, and granules are applied the asphalt.

Figure 2:
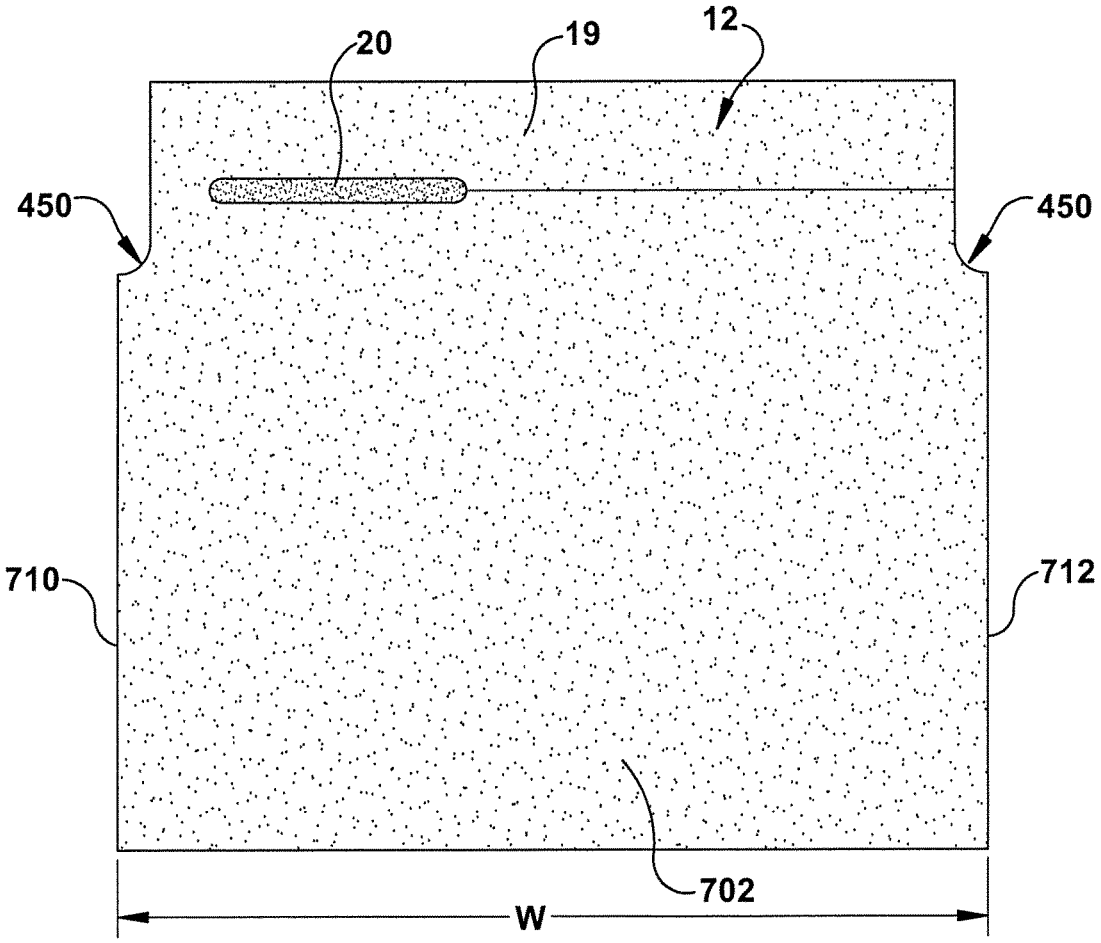
FIG. 2 illustrates the base layer shown in FIG. 1 with a laminating adhesive applied to the base layer.
Figure 3:
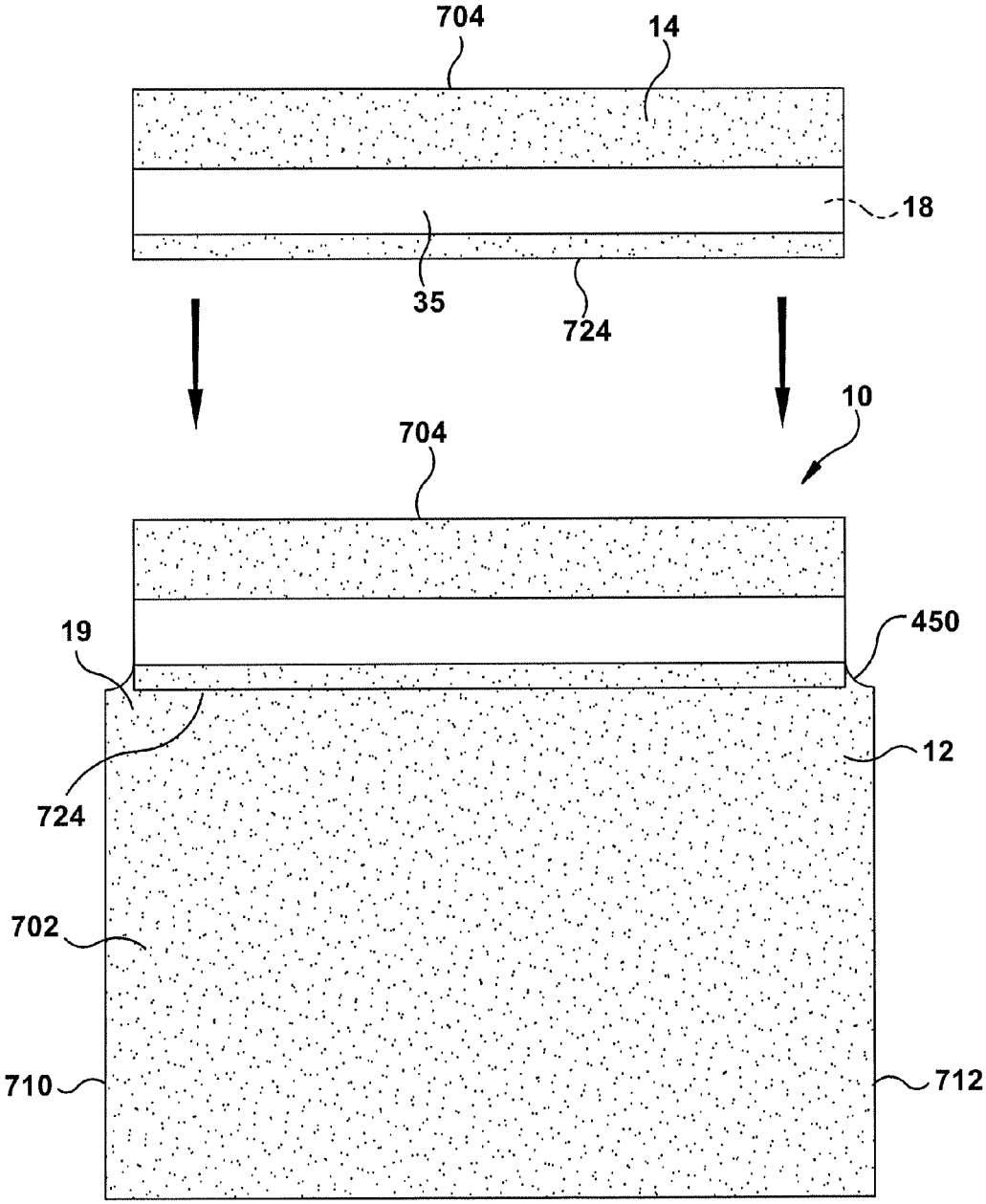
FIG. 3 illustrates assembly of the base layer illustrated by FIG. 2 assembled with the dimensional layer illustrated by FIG. 1 to form a laminated hip and ridge shingle.

Referring to FIGS. 2 and 3, in an exemplary embodiment, a bottom surface 18 of the dimensional layer 14 is adhered to the top surface 19 of the base layer 12 by an adhesive 20. In the illustrated embodiment, the adhesive 20 extends only partially across the overlap between the base layer 12 and the dimensional layer 14. In the illustrated embodiments, the adhesive is disposed on only one lateral side of the base and dimensional layers. Referring to FIG. 1B, the portion of the base layer 12 that is not covered by the dimensional layer 14 is the portion of the shingle that will be exposed on the ridge of the roof. The dimensional layer 14 will be completely covered by the base layer 12 of the next shingle applied to the ridge 118. The dimensional layer 14 increases the thickness of the overlapping portions of two shingles 10. This provides the ridge 118 with a more dimensional appearance.

Figure 9:
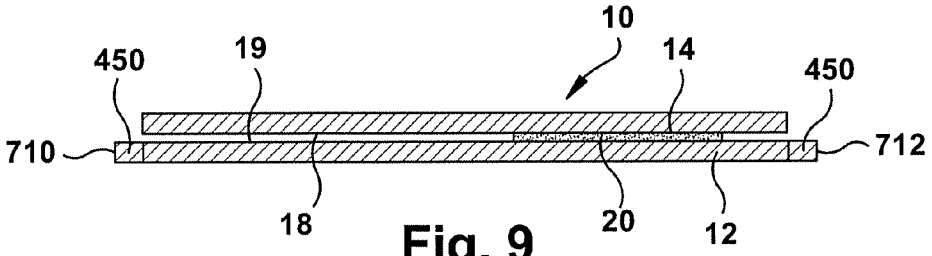
FIG. 9 is a front elevational view of the laminated hip and ridge shingle illustrated by FIG. 3.
Figure 10:
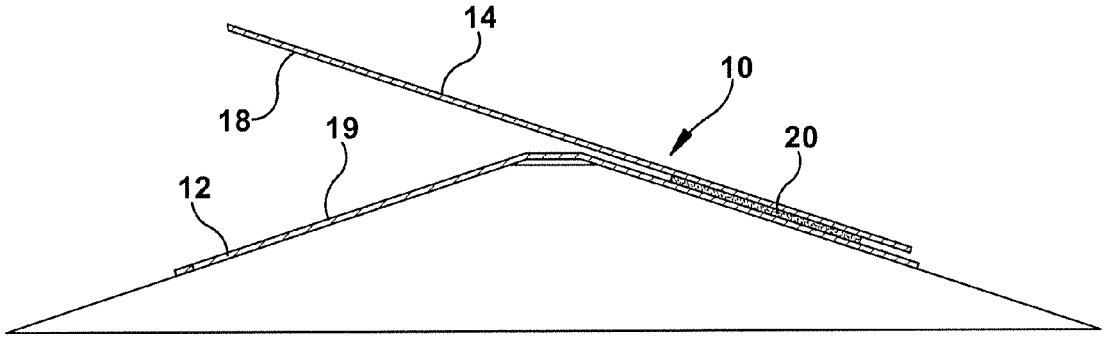
FIG. 10 illustrates the laminated hip and ridge shingle illustrated by FIG. 9 being mounted onto a roof peak.
Figure 11:
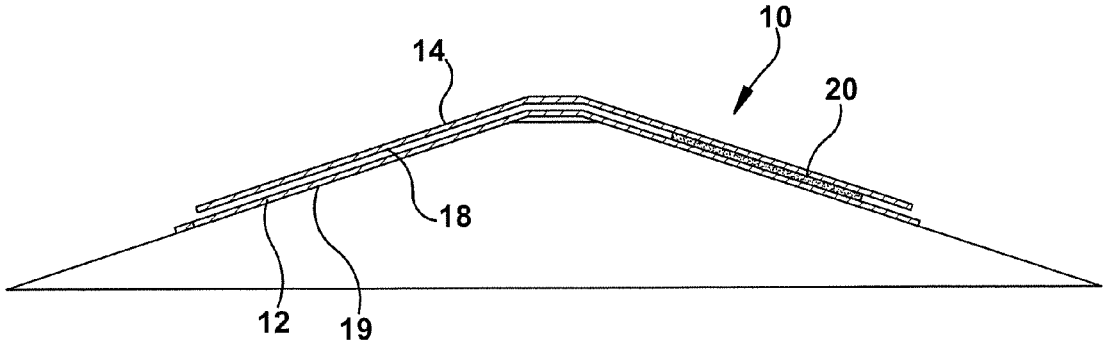
FIG. 11 illustrates the laminated hip and ridge shingle illustrated by FIG. 9 mounted on a roof peak.

In the exemplary embodiment illustrated by FIG. 3, the entire dimensional layer 14 is on top of the base layer 12 (i.e. complete overlap). This complete overlap reduces the possibility that water can pass between the layers 12, 14 where the adhesive is not present. Referring to FIGS. 9-11, by having the adhesive 20 extend only partially across the overlap between the first and second layers and on only one lateral side of the shingle, the shingle 10 can be bent over the ridge 118 of the roof without tearing, buckling or otherwise damaging the top layer. FIGS. 10 and 11 illustrate that the portion of the dimensional layer 14 that is not adhered to the base layer 12 is able to slide or laterally move with respect to the base layer 12. This sliding or lateral movement allows the laminated shingle 10 to be bent over a roof ridge 118 without damaging the dimensional layer 14.

Referring to FIGS. 1 and 3, an optional nail zone reinforcement material 35 is provided. The nail zone reinforcement material 35 can take a wide variety of different forms and can be applied to the laminated shingle at a wide variety positions. For example, the nail zone reinforcement material 35 can be a woven fabric, a plastic film, a metal strip, applied paint, and the like. The nail zone reinforcement material 35 can be provided on top of the dimensional layer 14, on the bottom of the dimensional layer, on top of the base layer 12, on the bottom of the base layer 12, or inside the base layer or dimensional layer. A nail line marking or other indicia may be provided on top of the dimensional layer 14 when nail line reinforcement material is not provided on the top layer. More than one nail zone reinforcement material may be provided. U.S. Pat. No. 8,607,521 discloses examples of nail zone reinforcement materials, methods of applying nail zone reinforcement materials to shingles, and shingles having reinforced nail zones that can be adapted into the shingles 10 disclosed by the present application. U.S. Pat. No. 8,607,521 is incorporated herein by reference in its entirety. In the illustrated embodiment, the nail zone reinforcement material 35 is a woven fabric that prevents the shingle from being pulled over a nail-head that secures the shingle to the roof.

Figure 7:
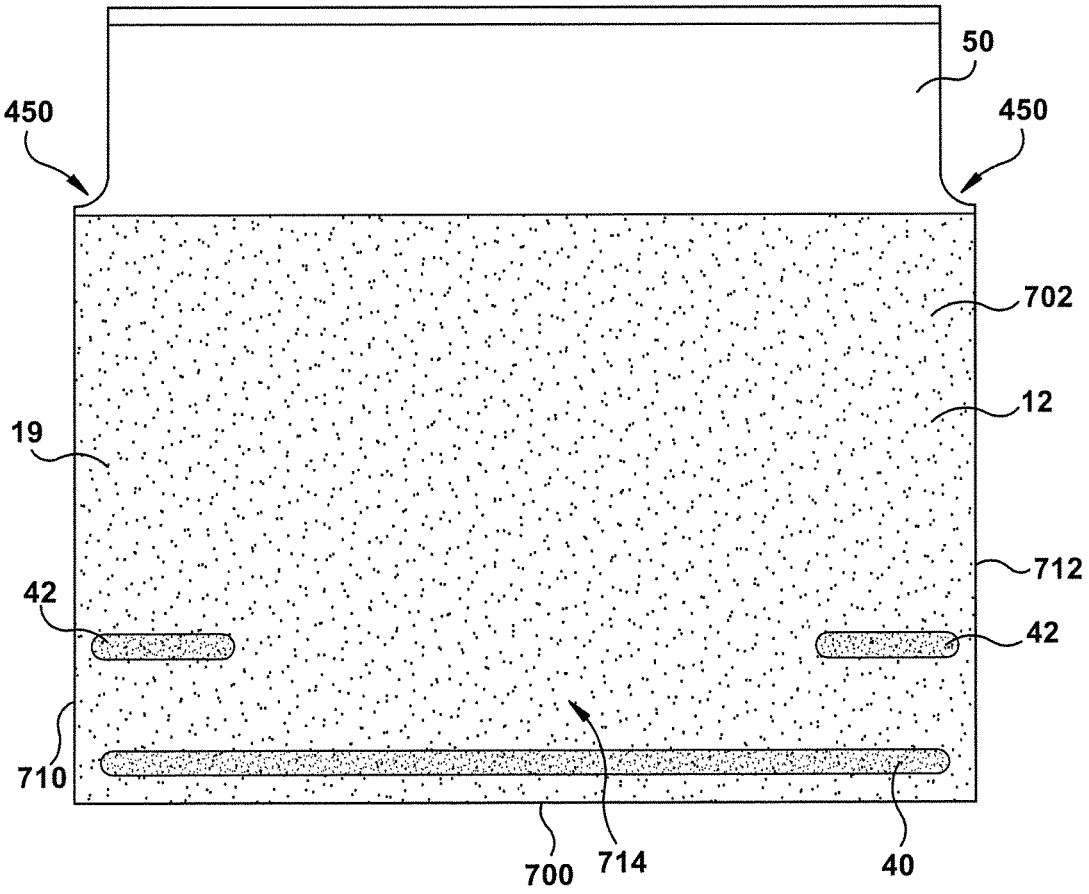
FIG. 7 is a rear view of a first exemplary embodiment of the base layer illustrated by FIG. 1.
Figure 8:
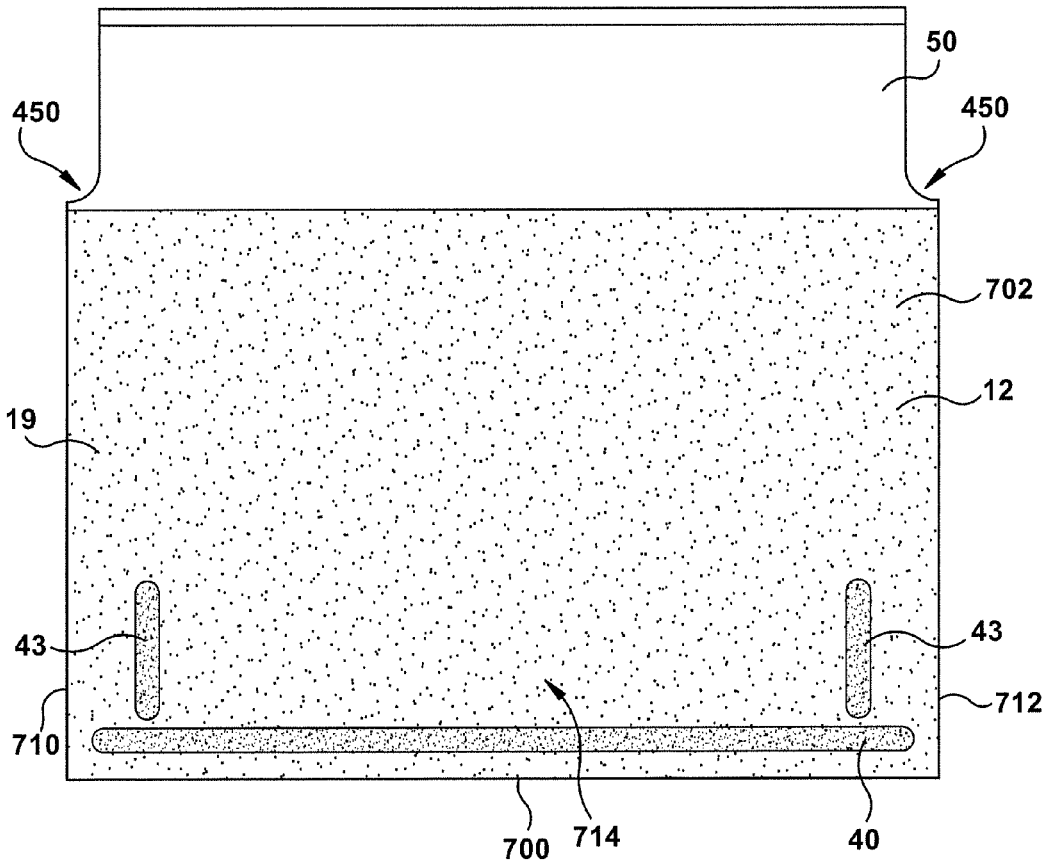
FIG. 8 is a rear view of a second exemplary embodiment of the base layer illustrated by FIG. 1.

Referring to FIGS. 7 and 8, in an exemplary embodiment adhesive and/or sealant lines 40 and/or 42 are provided on the bottom of the base layer 12. When a shingle is installed over another shingle on the roof ridge, the adhesive lines 40 and/or 42 adhere to the upper surface of the dimensional layer 14 to secure the shingles together. The adhesive lines 40 and/or 42 can have a wide variety of different configurations. In the exemplary embodiment illustrated by FIG. 7, the adhesive line 40 extends along substantially an entire width and is close to an edge 700 of the base layer 12. In an exemplary embodiment, the adhesive line 40 extends in the machine direction (i.e. the direction in which the base layer travels through a production line as it is made (described in more detail below), which is also the direction of the width of the shingle. In the illustrated embodiment, the adhesive line 40 is continuous. In other embodiments, the adhesive line 40 may be dashed. In an exemplary embodiment, the adhesive line 40 is positioned to adhere to granules 702 on the dimensional layer 14 between the reinforcement material 35 and an edge 704. In another embodiment, the adhesive line 40 is positioned to adhere to the reinforcement material 35. In the exemplary embodiment illustrated by FIG. 7, the adhesive lines 42 each start inward of side edges 710, 712 and extend a short distance, leaving a large gap 714 between the lines 42. The adhesive lines 42 may be close to or substantially spaced apart from the adhesive line 40. In another exemplary embodiment, a single line 42 extend along substantially an entire width of the base layer 12. In an exemplary embodiment, the adhesive line 42 extends in the direction of the width of the shingle, which may also be the machine direction (i.e. the direction in which the base layer travels through a production line as it is made. In another exemplary embodiment, the height of the shingle is the machine direction and the adhesive line 42 is applied in the cross-machine direction. In an exemplary embodiment, the adhesive lines 42 are positioned to adhere to granules 702 on the dimensional layer 14 between the reinforcement material 35 and an edge 724. In another embodiment, the adhesive lines 42 are positioned to adhere to the reinforcement material 35. In an exemplary embodiment, the sealant configuration illustrated by FIG. 7 provides enhanced resistant to the shingle edge pulling up due to wind that blows in a direction perpendicular to the side edge 710 or 712 of the shingle 10.

In the exemplary embodiment illustrated by FIG. 8, the adhesive line 40 extends along substantially an entire width and is close to an edge 700 of the base layer 12. In an exemplary embodiment, the adhesive line 40 extends in the machine direction (i.e. the direction in which the base layer travels through a production line as it is made (described in more detail below), which may also the direction of the width of the shingle. In the illustrated embodiment, the adhesive line 40 is continuous. In other embodiments, the adhesive line 40 may be dashed. In an exemplary embodiment, the adhesive line 40 is positioned to adhere to granules 702 on the dimensional layer 14 between the reinforcement material 35 and an edge 704. In another embodiment, the adhesive line 40 is positioned to adhere to the reinforcement material 35. In the exemplary embodiment illustrated by FIG. 8, the adhesive lines 42 extend from the adhesive line 40 along the side edges 710, 712. A large gap 714 is between the lines 42. In an exemplary embodiment, the adhesive lines 42 extend perpendicular to the machine direction or in the direction of the height of the shingle. In an exemplary embodiment, the adhesive lines 42 are positioned to adhere to granules 702 and to the reinforcement material 35 on the dimensional layer 14. In an exemplary embodiment, the sealant configuration illustrated by FIG. 8 provides enhanced resistant to the shingle edge pulling up due to wind that blows in a direction perpendicular to the side edge 710 or 712 of the shingle 10.

Referring to FIGS. 7 and 8, a release tape 50 is provided on the back side of the base layer 12. The laminated hip and ridge shingles 10 are flipped over and turned 180 degrees when they are packaged, so that the release tape 50 lines up with the adhesive lines 40, 42. In an exemplary embodiment, the release tape is wide enough to cover both lines of adhesive 40, 42. In another embodiment, two strips of release tape are provided to cover the two lines of adhesive. The release tape 50 prevents the shingles from sticking together in the package. The release tape 50 can take a wide variety of different forms.

Figure 5:
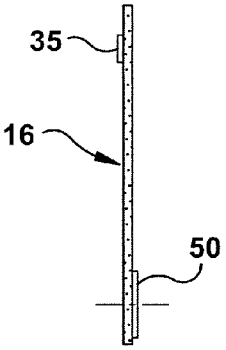
FIG. 5 is a side view of the shingle illustrated by FIG. 4.
Figure 4:
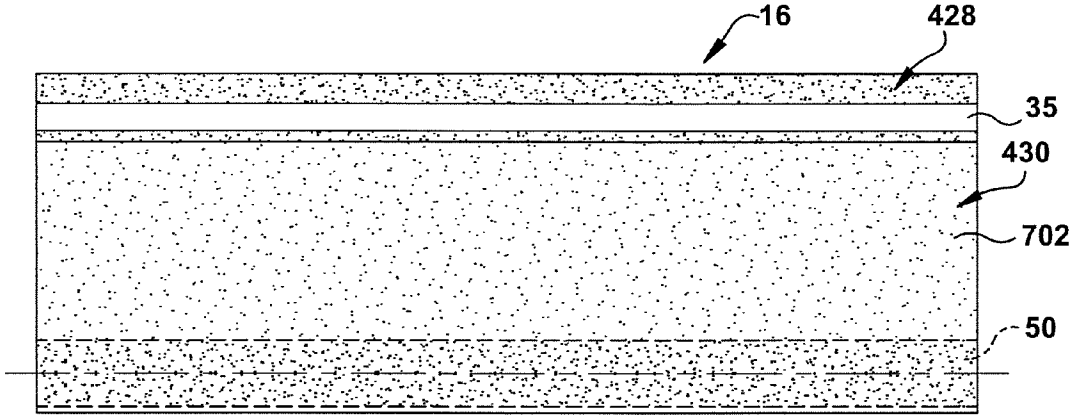
FIG. 4 illustrates a single one-layer shingle that can be used to make three of the laminated hip and ridge shingles illustrated by FIG. 3.
Figure 6:
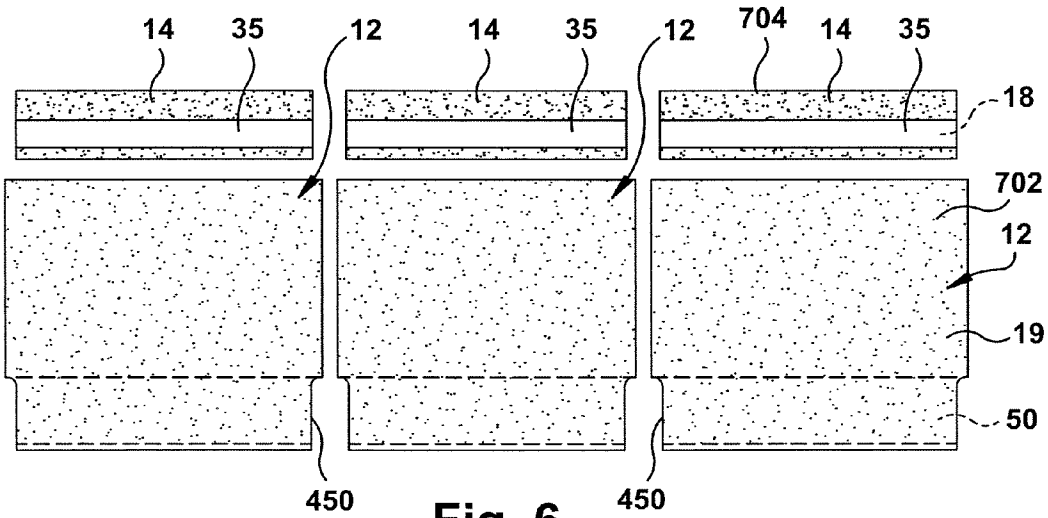
FIG. 6 illustrates the shingle illustrated by FIG. 4 cut into the base layer and the dimensional layer illustrated by FIG. 1.

Referring to FIGS. 4-6, the hip and ridge shingles 10 are constructed by cutting a single layer granule coated substrate 16 or shingle blank into pieces to make the base layer 12 and the dimensional layer 14. In the illustrated embodiment, the shingle blank 16 includes a headlap region 428 and a prime region 430. The headlap region 428 of the shingle blank 426 is used to make the dimensional layer 14. The prime region 430 of the shingle blank 426 is the portion of the hip or ridge roofing material that remains exposed when the hip and ridge shingles 10 are installed. In one exemplary embodiment, the entire front surface of the shingle blank 426 is coated with prime roofing granules and the entire rear surface of the shingle blank 426 is covered with headlap granules.

Referring again to FIG. 4, the shingle blank 16 may have any suitable dimensions. The shingle blank 426 may also be divided between the headlap region 428 and the prime region 430 in any suitable proportion. For example, a typical residential roofing shingle blank 16 has a length L of approximately 36 inches (91.5 cm) and a height H of approximately 13¼ inches high, with the height H dimension being divided between the headlap region 428 and the prime region 430.

In one exemplary embodiment, the shingle blank 16 has the same composition as the incorporated '994 patent to Miller et al. In another embodiment, the shingle blank can have other suitable compositions. The shingle blank 16 includes a substrate that is coated with an asphalt coating. The asphalt coating includes an upper section that is positioned above the substrate when the roofing material is installed on a roof, and a lower section that is positioned below the substrate. The upper section includes an upper surface. Referring to FIGS. 4 and 5, in an exemplary embodiment, the nail zone reinforcement material 35 is pressed into the upper section of the asphalt coating to embed the nail zone reinforcement material 35 in the asphalt. A layer of granules 702 is then pressed into the upper section asphalt coating. In an exemplary embodiment, the layer of granules 702 do not stick to the nail zone reinforcement material 35. The release tape 50 is pressed against the lower section of the asphalt coating. A layer of granules 702 or a layer of back dusting is then pressed into the lower section asphalt coating. In an exemplary embodiment, the layer of granules 702 or back dusting do not stick to the release tape 50. In an exemplary embodiment, granules 702 are used on both sides of the shingle blank 16 to make the laminated hip and ridge shingle thicker.

Referring to FIGS. 4-6, in an exemplary embodiment a single layer shingle layer or blank 16 is cut up and assembled to make the laminated shingle. In this example, the laminated shingle will typically be assembled in an off-line process. That is, the laminated shingles are not produced in a continuous line. In an exemplary embodiment, the blank is cut as shown in FIG. 6. The dimensional layers 14 may be about 11 inches wide. The base layer 12 may be about 12 inches wide with scallop cuts 450 at the end with the release tape 50 that reduce the width to about 11 inches at the scallop cuts. The base layer is flipped over and adhesive 20 is applied partially across the base layer as illustrated by FIG. 2. The dimensional layer 14 is then adhered to the adhesive 20 as illustrated by FIG. 3. The shingle 10 is then flipped over and the sealant 40, 42 and/or 43 is applied, for example, as illustrated by FIG. 7 or FIG. 8 to complete the shingle. The shingles 10 are then alternately flipped and stacked, such that the sealant 40, 42 and/or 43 is disposed against the release tape 50 and the shingles do not stick together. In another exemplary embodiment, the laminated shingles are assembled in an inline process on a continuous production line.

In an exemplary embodiment, the scallop cuts 450 and the narrower width dimensional layer 14 keep the nail zone reinforcement material 35 from being exposed when the shingle 10 is installed on a roof as illustrated by FIGS. 1B and 11. That is, the base layer 12 of an overlying shingle completely covers the dimensional layer 14 of the underlying shingle, due to the narrower width of the dimensional layer 14.

Figure 28:
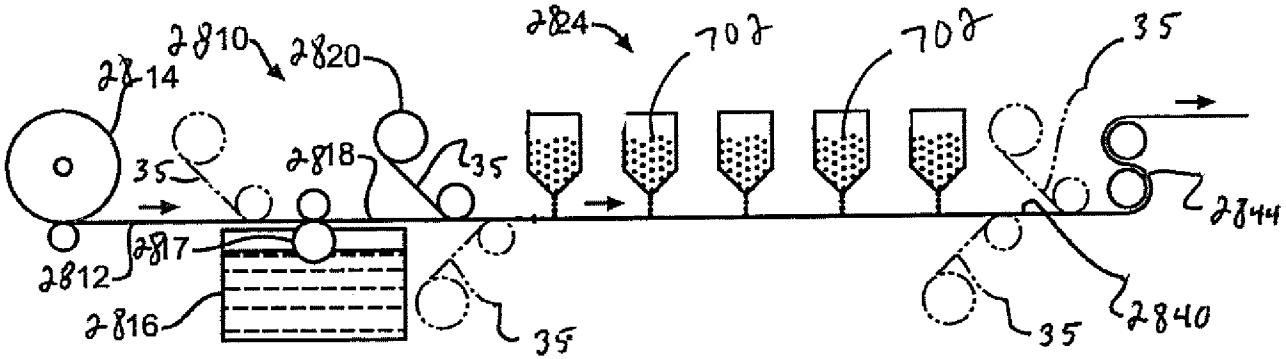
FIG. 28 is a schematic illustration of an apparatus for making single layer shingle blanks.

The shingle blank 16 can be made in a wide variety of different ways. In one exemplary embodiment, a process and apparatus that may be adapted to be used to manufacture the single layer shingle blank 16 is described in U.S. Pat. No. 8,607,521 to Belt et al. and is only summarized herein. There is shown in FIG. 28 an apparatus 2810 for manufacturing an asphalt-based roofing material. In the illustrated embodiment, the manufacturing process involves passing a continuous sheet 2812 in a machine direction (indicated by the arrows) through a series of manufacturing operations. The sheet usually moves at a speed of at least about 200 feet/minute (61 meters/minute), and typically at a speed within the range of between about 450 feet/minute (137 meters/minute) and about 800 feet/minute (244 meters/minute). In one exemplary embodiment, the sheet moves at a speed of at least about 200 feet/minute (61 meters/minute), and less than about 450 feet/minute (137 meters/minute). The sheet, however, may move at any desired speed.

In a first step of the illustrated manufacturing process, a continuous sheet of substrate or shingle mat 2812 is payed out from a roll 2814. The substrate can be any type known for use in reinforcing asphalt-based roofing materials, such as a non-woven web of glass fibers. The shingle mat 2812 may be fed through a coater 2816 where an asphalt coating is applied to the mat 2812. The asphalt coating can be applied in any suitable manner. In the illustrated embodiment, the mat 2812 contacts a roller 2817, that is in contact with a supply of hot, melted asphalt. The roller 2817 completely covers the mat 2812 with a tacky coating of hot, melted asphalt to define a first asphalt coated sheet 2818. In other embodiments, however, the asphalt coating could be sprayed on, rolled on, or applied to the sheet by other means.

A continuous strip of a reinforcement material or tape 35, as will be described in detail herein, may then be payed out from a roll 2820. The reinforcement tape 35 adheres to the asphalt coated sheet 2818. In one embodiment, the reinforcement tape 35 is attached to the sheet 2818 by the adhesive mixture of the asphalt in the asphalt coated sheet 2818. The reinforcement tape 35, however, may be attached to the sheet 2818 by any suitable means, such as other adhesives. In one embodiment, the reinforcement material 35 is formed from polyester. In another embodiment, the reinforcement material is formed from polyolefin, such as polypropylene or polyethylene. The reinforcement material 35, however, can be formed from any material for reinforcing and strengthening the nail zone of a shingle, such as, for example, paper, film, scrim material, and woven or non-woven glass.

The resulting asphalt coated sheet may then be passed beneath a series of granule dispensers 2824 for the application of granules to the upper surface of the asphalt coated sheet 2818. The granule dispensers can be of any type suitable for depositing granules onto the asphalt coated sheet. A granule dispenser that can be used is a granule valve of the type disclosed in U.S. Pat. No. 6,610,147 to Aschenbeck. After all the granules are deposited on the asphalt coated sheet by the series of dispensers 2824, the sheet 2818 becomes a granule covered sheet 2840.

In one embodiment, the reinforcement material 35 includes an upper surface to which granules substantially will not adhere. The reinforcement material 35, however, may include an upper surface to which granules will adhere. For example, the apparatus 2810 may include any desired means for depositing granules onto substantially the entire second asphalt coated sheet 2818, except for the portion of the second asphalt coated sheet 2818 covered by the material 35. Alternately, granules may be deposited onto substantially the entire asphalt coated sheet 2818, including the material 35, but wherein the reinforcement material 35 includes an upper surface to which granules substantially will not adhere.

The granule covered sheet 40 may then be turned around a drum 2844 to press the granules into the asphalt coating and to temporarily invert the sheet so that the excess granules will fall off and will be recovered and reused.

In one embodiment, the reinforcement material 35 may be attached to the shingle blank prior to the application of the asphalt coating, after the application of the asphalt coating, prior to application of granules, after application of granules, and at any of the locations illustrated by FIG. 28. Further, the release tape 50 may be applied at any of the locations and in the same manner as illustrated for the reinforcement material in FIG. 28.

It will be understood, however, that in any of the embodiments described herein, reinforcement material 35 may be applied as an extruded or liquid material, such as a polymer, that will adhere to the mat 2812, the asphalt covered sheet 2818, the granule covered sheet 2840, and/or the lower surface of the asphalt coated sheet.

In another embodiment of the invention, a layer of material, such as talc or sand, may be applied to the first asphalt coated sheet 2818 shown in FIG. 28. The material may be applied by any desired means to a lower surface of the asphalt coated sheet 2818. Alternatively, granules 702 may be applied by any desired means to a lower surface of the asphalt coated sheet 2818 to make a thicker shingle blank.

In the exemplary shingle 10 may have a nail pull-through value, measured in accordance with a desired standard, such as prescribed by ASTM test standard D3462. For example, the shingle 10 may have a nail pull-through value that is greater than in an otherwise identical shingle 10 having no such reinforcement 35. In one embodiment, the shingle 10 may have a nail pull-through value within the range of from about ten percent to about 100 percent greater than in an otherwise identical shingle having no such reinforcement material 35. In another embodiment, the shingle 10 may have a nail pull-through value about 50 percent greater than in an otherwise identical shingle having no such reinforcement material 35.

In another embodiment, a shingle 10 having a reinforcement material 35 formed from polyester film having a thickness of about 0.5 mils, may have a nail pull-through value about 13.3 percent greater than in an otherwise identical shingle having no such reinforcement material 35. In another embodiment, a shingle having a reinforcement material 35 fixated from polyester film having a thickness of about 3.0 mils, may have a nail pull-through value about 62.3 percent greater than in an otherwise identical shingle having no such material 35. In another embodiment, a shingle having a reinforcement material 35 formed from polyester film having a thickness of about 4.0 mils, may have a nail pull-through value about 86.0 percent greater than in an otherwise identical shingle having no such reinforcement material 35. In another embodiment, a shingle having a reinforcement tape 19 formed from polyester film having a thickness of about 5.0 mils, may have a nail pull-through value about 112.7 percent greater than in an otherwise identical shingle having no such tape 19.

Figure 14:
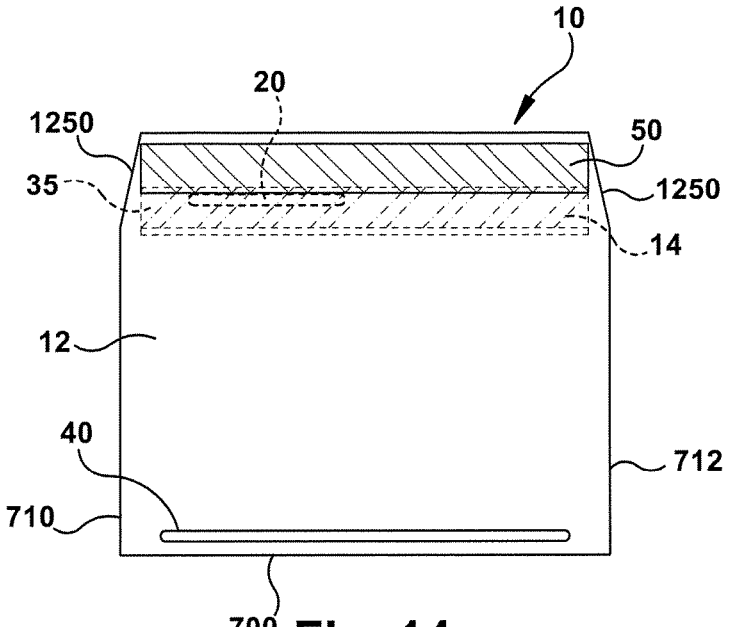
FIG. 14 is a rear view of the laminated hip and ridge shingle illustrated by FIG. 12.
Figure 12:
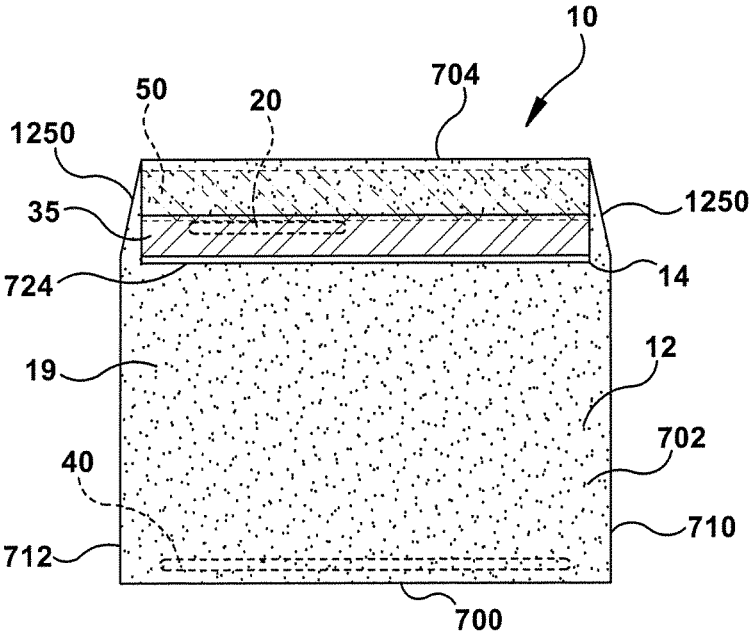
FIG. 12 is a top view of another exemplary embodiment of a laminated hip and ridge shingle.
Figure 13:
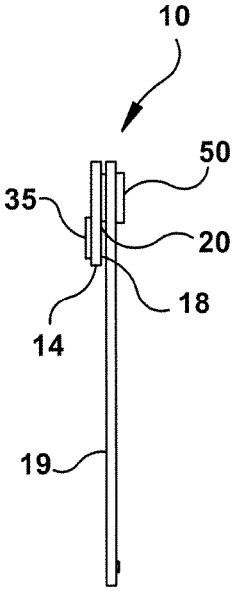
FIG. 13 is a side view of the laminated hip and ridge shingle illustrated by FIG. 12.

FIGS. 12-14 illustrate another exemplary embodiment of a laminated hip and ridge shingle 10. The laminated shingle 10 includes a base layer 12 and a dimensional layer 14. Referring to FIG. 13, in an exemplary embodiment, the bottom surface 18 of the dimensional layer 14 is adhered to the top surface 19 of the base layer 12 by an adhesive 20. In the illustrated embodiment, the adhesive 20 extends only partially across the overlap between the base layer 12 and the dimensional layer 14. The portion of the base layer 12 that is not covered by the dimensional layer 14 is the portion of the shingle that will be exposed on the ridge of the roof. The dimensional layer 14 will be completely covered by the base layer 12 of the next shingle applied to the ridge 118. The dimensional layer 14 increases the thickness of the overlapping portions of two shingles 10. This provides the ridge 118 with a more dimensional appearance.

In the exemplary embodiment, the entire dimensional layer 14 is on top of the base layer 12 (i.e. complete overlap). This complete overlap reduces the possibility that water can pass between the layers 12, 14 where the adhesive is not present. By having the adhesive 20 extend only partially across the overlap between the first and second layers, the shingle 10 can be bent over the ridge 118 of the roof without tearing the top layer.

Referring to FIG. 12, an optional nail zone reinforcement material 35 is provided. The nail zone reinforcement material 35 can take a wide variety of different forms and can be applied to the laminated shingle at a wide variety positions. For example, the nail zone reinforcement material 35 can be a woven fabric, a plastic film, a metal strip, paint, and the like. The nail zone reinforcement material 35 can be provided on top of the dimensional layer 14, on the bottom of the dimensional layer, on top of the base layer 12, on the bottom of the base layer 12, in between the base and dimensional layers 12, 14, or inside the base layer or dimensional layer. More than one nail zone reinforcement material may be provided. In the illustrated embodiment, the nail zone reinforcement material 35 is a woven fabric that prevents the shingle from being pulled over a nail-head that secures the shingle to the roof.

Referring to FIG. 14, in an exemplary embodiment an adhesive line 40 is provided on the bottom of the base layer 12. The adhesive lines 42 and/or 43 (See FIGS. 7 and 8) can also optionally be included. When a shingle is installed over another shingle on the roof ridge, the adhesive line 40 adheres to the upper surface of the dimensional layer 14 to secure the shingles together. In the exemplary embodiment illustrated by FIG. 14, the adhesive line 40 extends along substantially an entire width and is close to an edge 700 of the base layer 12. In an exemplary embodiment, the adhesive line 40 extends in the direction of the width of the shingle, which may also be the machine direction (i.e. the direction in which the base layer travels through a production line as it is made. In another exemplary embodiment, the height of the shingle is the machine direction and the adhesive line 40 is applied in the cross-machine direction. In the illustrated embodiment, the adhesive line 40 is continuous. In other embodiments, the adhesive line 40 may be dashed. In an exemplary embodiment, the adhesive line 40 is positioned to adhere to granules 702 on the dimensional layer 14 between the reinforcement material 35 and an edge 704. In another embodiment, the adhesive line 40 is positioned to adhere to the reinforcement material 35.

Referring to FIG. 14, a release tape 50 is provided on the back side of the base layer 12. The laminated hip and ridge shingles 10 are flipped over and turned 180 degrees when they are packaged, so that the release tape 50 lines up with the adhesive line 40. The release tape 50 prevents the shingles from sticking together in the package. The release tape 50 can take a wide variety of different forms.

Referring to FIGS. 15-17, the hip and ridge shingles 10 illustrated by FIG. 12-14 are constructed by cutting a single layer granule coated substrate 16 or shingle blank into pieces to make the base layer 12 and the dimensional layer 14. In the illustrated embodiment, the shingle blank 16 includes a headlap region 428 and a prime region 430. The headlap region 428 of the shingle blank 426 is used to make the dimensional layer 14. The prime region 430 of the shingle blank 426 is the portion of the hip or ridge roofing material that remains exposed when the hip and ridge shingles 10 are installed. In one exemplary embodiment, the entire front surface of the shingle blank 426 is coated with prime roofing granules and the entire rear surface of the shingle blank 426 is covered with headlap granules.

Referring again to FIGS. 15-17, the shingle blank 16 may have any suitable dimensions. The shingle blank 426 may also be divided between the headlap region 428 and the prime region 430 in any suitable proportion. For example, a typical residential roofing shingle blank 16 has a length L of approximately 36 inches (91.5 cm) and a height H of approximately 13¼ inches (30.5 cm) high, with the height H dimension being divided between the headlap region 428 and the prime region 430.

In one exemplary embodiment, the shingle blank 16 has the same composition as the incorporated '994 patent to Miller et al. In another embodiment, the shingle blank can have other suitable compositions. The shingle blank 16 includes a substrate that is coated with an asphalt coating. The asphalt coating includes an upper section that is positioned above the substrate when the roofing material is installed on a roof, and a lower section that is positioned below the substrate. The upper section includes an upper surface. Referring to FIG. 15, in an exemplary embodiment, the nail zone reinforcement material 35 is pressed into the upper section of the asphalt coating to embed the nail zone reinforcement material 35 in the asphalt. A layer of granules 702 is then pressed into the upper section asphalt coating. In an exemplary embodiment, the layer of granules 702 do not stick to the nail zone reinforcement material 35. The release tape 50 is pressed against the lower section of the asphalt coating. A layer of granules or a layer of back dusting is then pressed into the lower section asphalt coating. In an exemplary embodiment, the layer of granules or back dusting do not stick to the release tape 50.

Referring to FIGS. 12-14, in an exemplary embodiment a single layer shingle or blank 16 is cut up and assembled to make the laminated shingle. In an exemplary embodiment, the blank is cut. The dimensional layers 14 may be about 11 inches wide. The base layer 12 may be about 12 inches wide with tapered cuts 1250 at the end with the release tape 50 that taper down to a width of about 11 inches.

FIGS. 18-21 illustrate another exemplary embodiment of a laminated hip and ridge shingle 10. The difference between the versions of the shingles 10 shown in FIGS. 12-14 and FIGS. 18-20 is the configuration of the overlap and the size of the dimensional layer 14. In the embodiment illustrated by FIGS. 18-20, the dimensional layer 14 is wider, but the area of overlap is narrow. In the exemplary embodiment illustrated by FIGS. 18-20, having a portion of the dimensional layer 14 not overlap with the base layer 12 provides a more gradual transition from one layer to two layers for supporting the next shingle on the roof ridge. In the exemplary embodiment illustrated by FIGS. 12-14, the entire dimensional layer 14 is on top of the base layer 12 (i.e. complete overlap).

Figure 18:
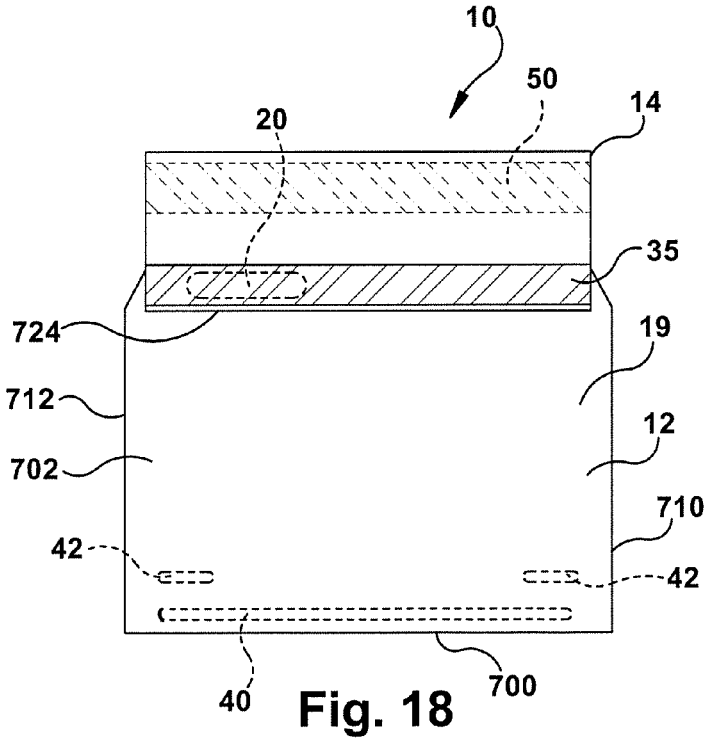
FIG. 18 is a top view of another exemplary embodiment of a laminated hip and ridge shingle.
Figure 19:
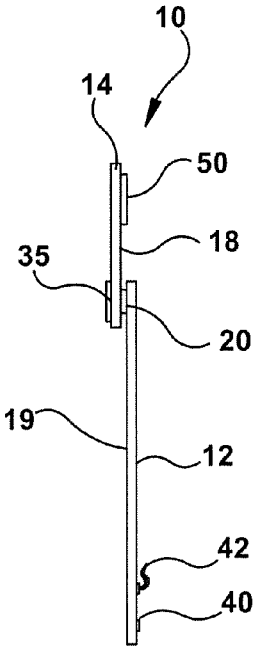
FIG. 19 is a side view of the laminated hip and ridge shingle illustrated by FIG. 18.
Figure 21:
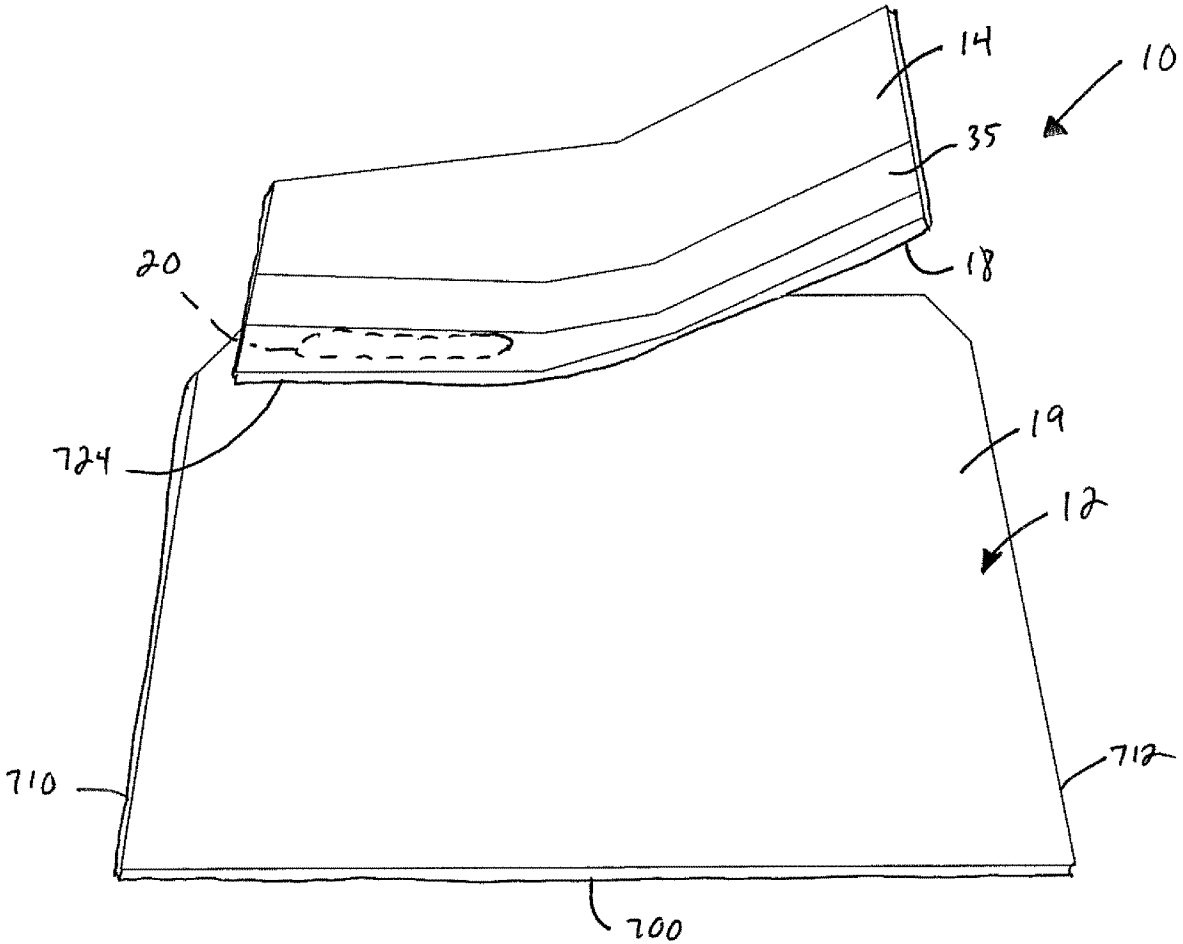
FIG. 21 is a perspective view of the laminated hip and ridge shingle illustrated by FIG. 18.

In the example illustrated by FIGS. 18-21, the laminated shingle 10 includes a base layer 12 and a dimensional layer 14. Referring to FIG. 19, in an exemplary embodiment, a bottom surface 18 of the dimensional layer 14 is adhered to the top surface 19 of the base layer 12 by an adhesive 20. In the illustrated embodiment, the adhesive 20 extends only partially across the overlap between the base layer 12 and the dimensional layer 14. The portion of the base layer 12 that is not covered by the dimensional layer 14 is the portion of the shingle that will be exposed on the ridge of the roof. The dimensional layer 14 will be completely covered by the base layer 12 of the next shingle applied to the ridge 118. The dimensional layer 14 increases the thickness of the overlapping portions of two shingles 10. This provides the ridge 118 with a more dimensional appearance.

Referring to FIG. 18, an optional nail zone reinforcement material 35 is provided. The nail zone reinforcement material 35 can take a wide variety of different forms and can be applied to the laminated shingle at a wide variety positions. For example, the nail zone reinforcement material 35 can be a woven fabric, a plastic film, a metal strip, and the like. The nail zone reinforcement material 35 can be provided on top of the dimensional layer 14, on the bottom of the dimensional layer, on top of the base layer 12, on the bottom of the base layer 12, or inside the base layer or dimensional layer. More than one nail zone reinforcement material may be provided. In the illustrated embodiment, the nail zone reinforcement material 35 is a woven fabric that prevents the shingle from being pulled over a nail-head that secures the shingle to the roof.

Figure 20:
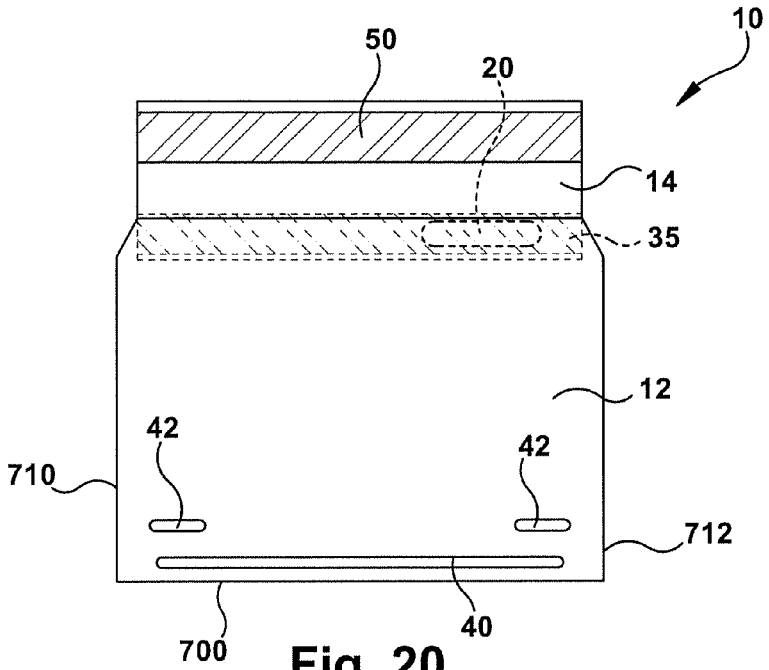
FIG. 20 is a rear view of the laminated hip and ridge shingle illustrated by FIG. 18.

Referring to FIG. 20, in an exemplary embodiment an adhesive line 40 is provided on the bottom of the base layer 12. The adhesive lines 42 and/or 43 can also optionally be included (See FIGS. 7 and 8). When a shingle is installed over another shingle on the roof ridge, the adhesive line 40 adheres to the upper surface of the dimensional layer 14 to secure the shingles together. In the exemplary embodiment illustrated by FIG. 20, the adhesive line 40 extends along substantially an entire width and is close to an edge 700 of the base layer 12. In an exemplary embodiment, the adhesive line 40 extends in the machine direction (i.e. the direction in which the base layer travels through a production line as it is made (described in more detail below), which is also the direction of the width of the shingle. In the illustrated embodiment, the adhesive line 40 is continuous. In other embodiments, the adhesive line 40 may be dashed. In an exemplary embodiment, the adhesive line 40 is positioned to adhere to granules 702 on the dimensional layer 14 between the reinforcement material 35 and an edge 704. In another embodiment, the adhesive line 40 is positioned to adhere to the reinforcement material 35.

Referring to FIG. 20, a release tape 50 is provided on the back side of the dimensional layer 14. The laminated hip and ridge shingles 10 are flipped over and turned 180 degrees when they are packaged, so that the release tape 50 lines up with the adhesive line 40. The release tape 50 prevents the shingles from sticking together in the package. The release tape 50 can take a wide variety of different forms.

Figure 22:
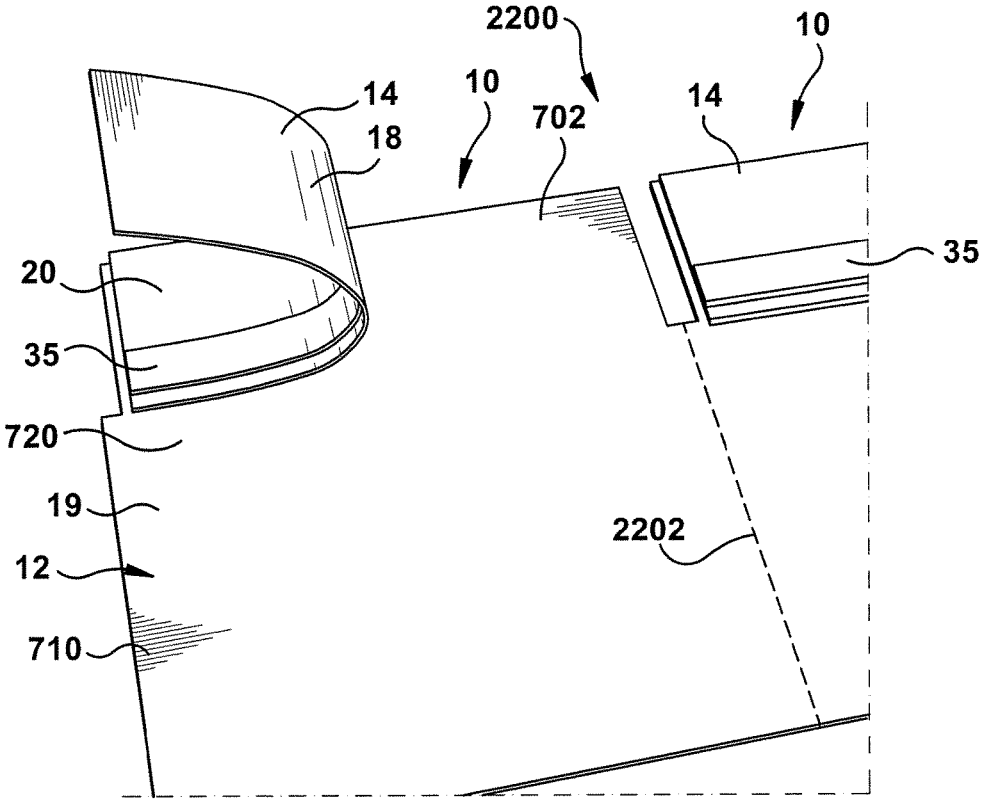
FIG. 22 is a perspective view of an exemplary embodiment of a laminated hip and ridge shingle array.
Figure 23:
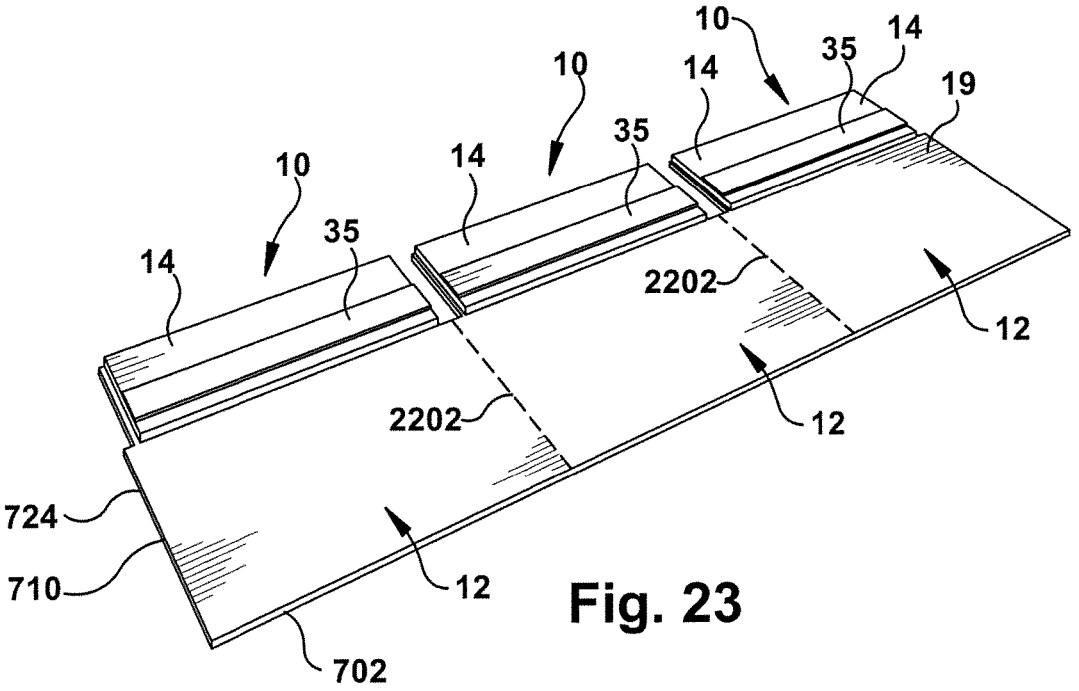
FIG. 23 is another perspective view of the laminated hip and ridge shingle array illustrated by FIG. 22.

FIGS. 22 and 23 illustrate an exemplary embodiment of an array 2200 of laminated hip and ridge shingles 10 connected by lines of perforations 2202. Each laminated shingle 10 of the array includes a base layer 12 and a dimensional layer 14. Referring to FIG. 22, in an exemplary embodiment, a bottom surface 18 of the dimensional layer 14 is adhered to the top surface 19 of the base layer 12 by an adhesive 20. In the illustrated embodiment, the adhesive 20 extends only partially across the overlap between the base layer 12 and the dimensional layer 14. The portion of the base layer 12 that is not covered by the dimensional layer 14 is the portion of the shingle that will be exposed on the ridge of the roof. The dimensional layer 14 will be completely covered by the base layer 12 of the next shingle applied to the ridge 118. The dimensional layer 14 increases the thickness of the overlapping portions of two shingles 10. This provides the ridge 118 with a more dimensional appearance.

In the exemplary embodiment, the entire dimensional layer 14 is on top of the base layer 12 (i.e. complete overlap). This complete overlap reduces the possibility that water can pass between the layers 12, 14 where the adhesive is not present. By having the adhesive 20 extend only partially across the overlap between the first and second layers, the shingle 10 can be bent over the ridge 118 of the roof without tearing the top layer.

In one exemplary embodiment, the array 2200 of shingles 10 has the same composition as the incorporated '994 patent to Miller et al. In another embodiment, the shingle blank can have other suitable compositions.

Figure 24:
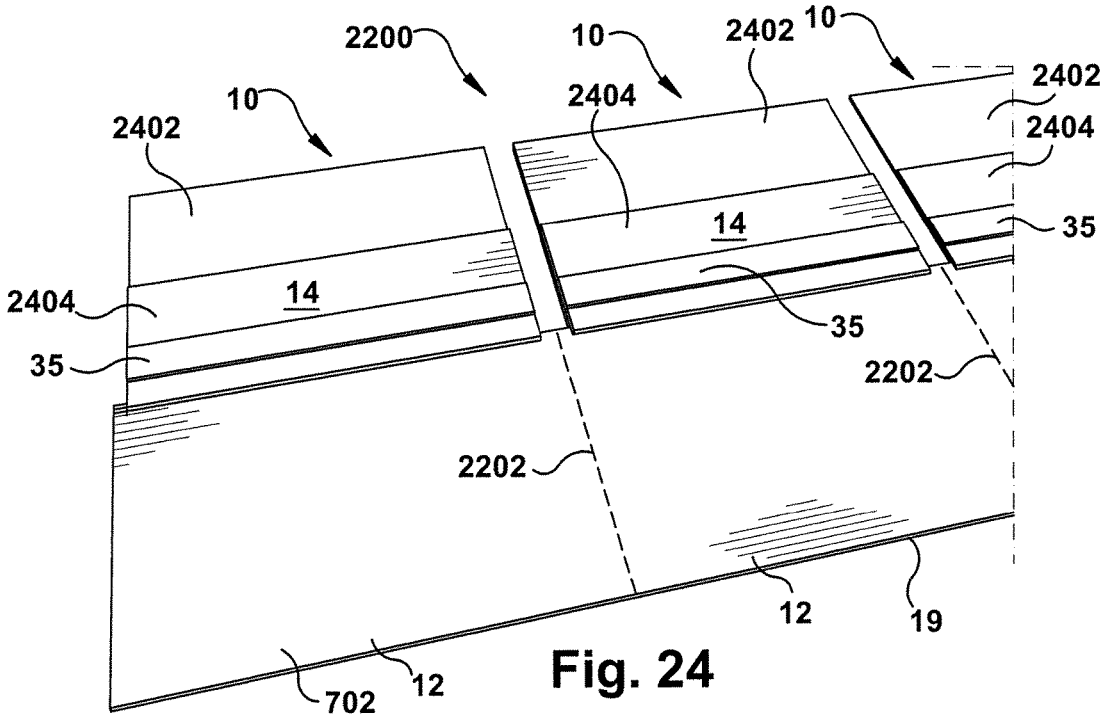
FIG. 24 is a perspective view of an exemplary embodiment of a laminated hip and ridge shingle array.
Figure 25:
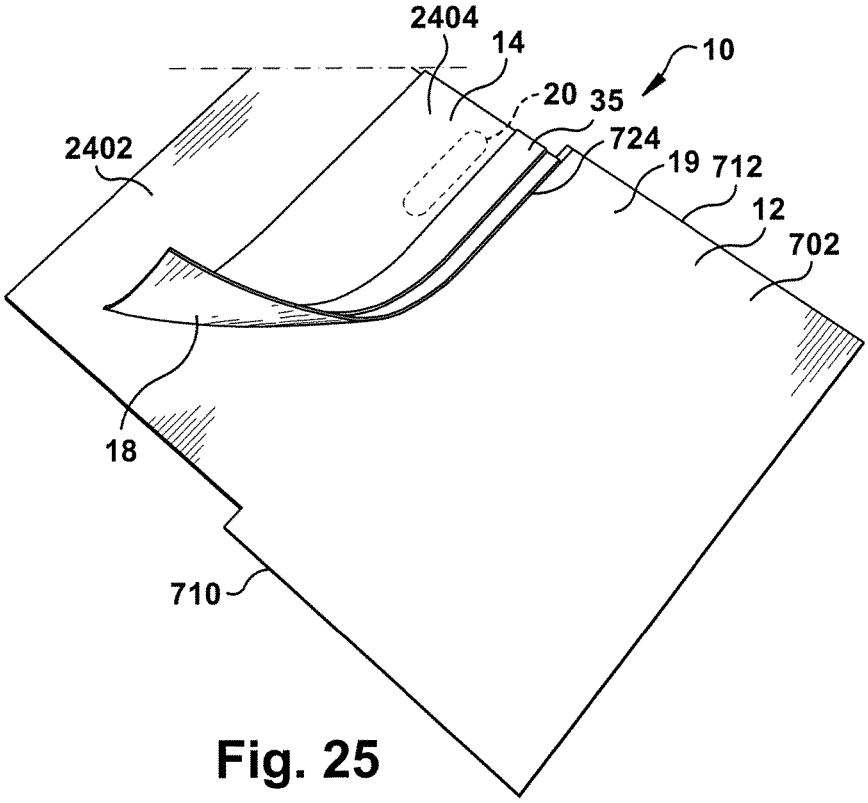
FIG. 25 is another perspective view of the laminated hip and ridge shingle array illustrated by FIG. 24.

FIGS. 24 and 25 illustrate an exemplary embodiment that is similar to the embodiment illustrated by FIGS. 22 and 23. The embodiment illustrated by FIGS. 24 and 25 differs in that the base layer 12 extend past the dimensional layer 14 to create a first step 2402 and a second step 2404. The first and second steps 2402, 2404 provide a more gradual transition from one layer to two layers for supporting the next shingle on the roof ridge.

Each laminated shingle 10 of the array illustrated by FIGS. 24 and 25 includes a base layer 12 and a dimensional layer 14. Referring to FIG. 22, in an exemplary embodiment, a bottom surface 18 of the dimensional layer 14 is adhered to the top surface 19 of the base layer 12 by an adhesive 20. In the illustrated embodiment, the adhesive 20 extends only partially across the overlap between the base layer 12 and the dimensional layer 14. The portion of the base layer 12 that is not covered by the dimensional layer 14 is the portion of the shingle that will be exposed on the ridge of the roof. The dimensional layer 14 will be completely covered by the base layer 12 of the next shingle applied to the ridge 118. The dimensional layer 14 increases the thickness of the overlapping portions of two shingles 10. This provides the ridge 118 with a more dimensional appearance.

In the exemplary embodiment, the entire dimensional layer 14 is on top of the base layer 12 (i.e. complete overlap). This complete overlap reduces the possibility that water can pass between the layers 12, 14 where the adhesive is not present. By having the adhesive 20 extend only partially across the overlap between the first and second layers, the shingle 10 can be bent over the ridge 118 of the roof without tearing the top layer.

Figure 26:
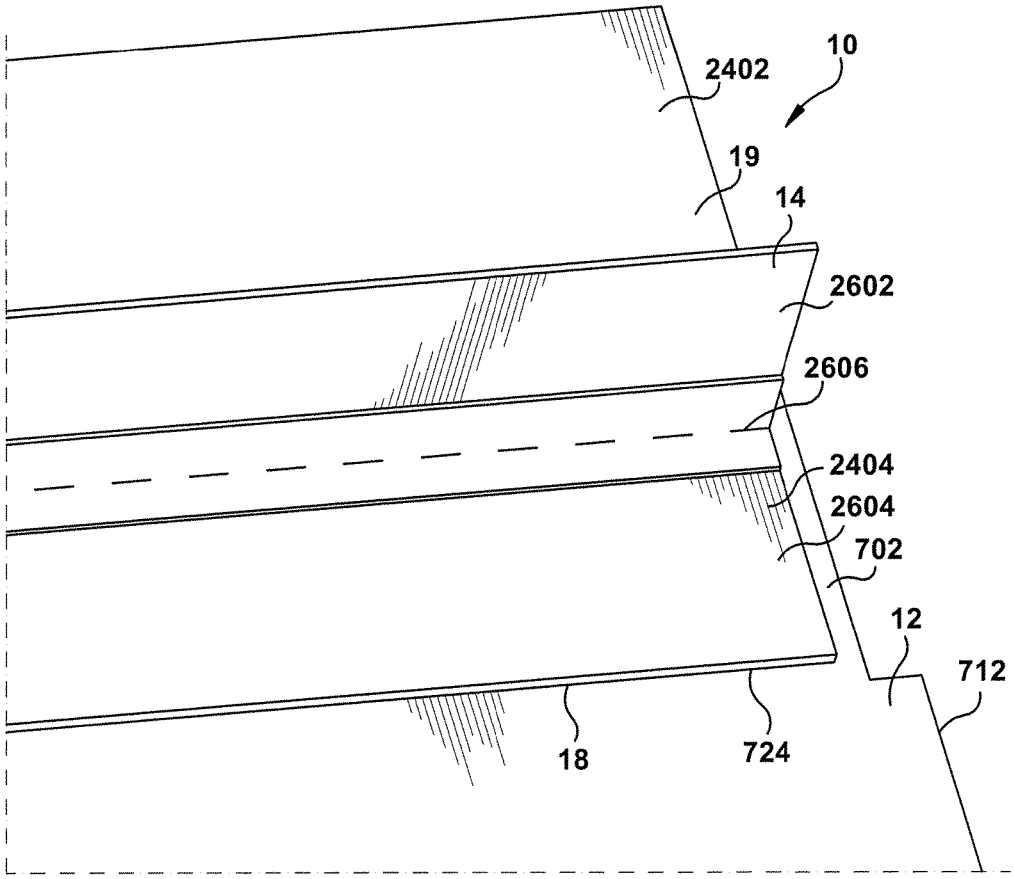
FIG. 26 is a perspective view of another exemplary embodiment of a laminated hip and ridge shingle.
Figure 27:
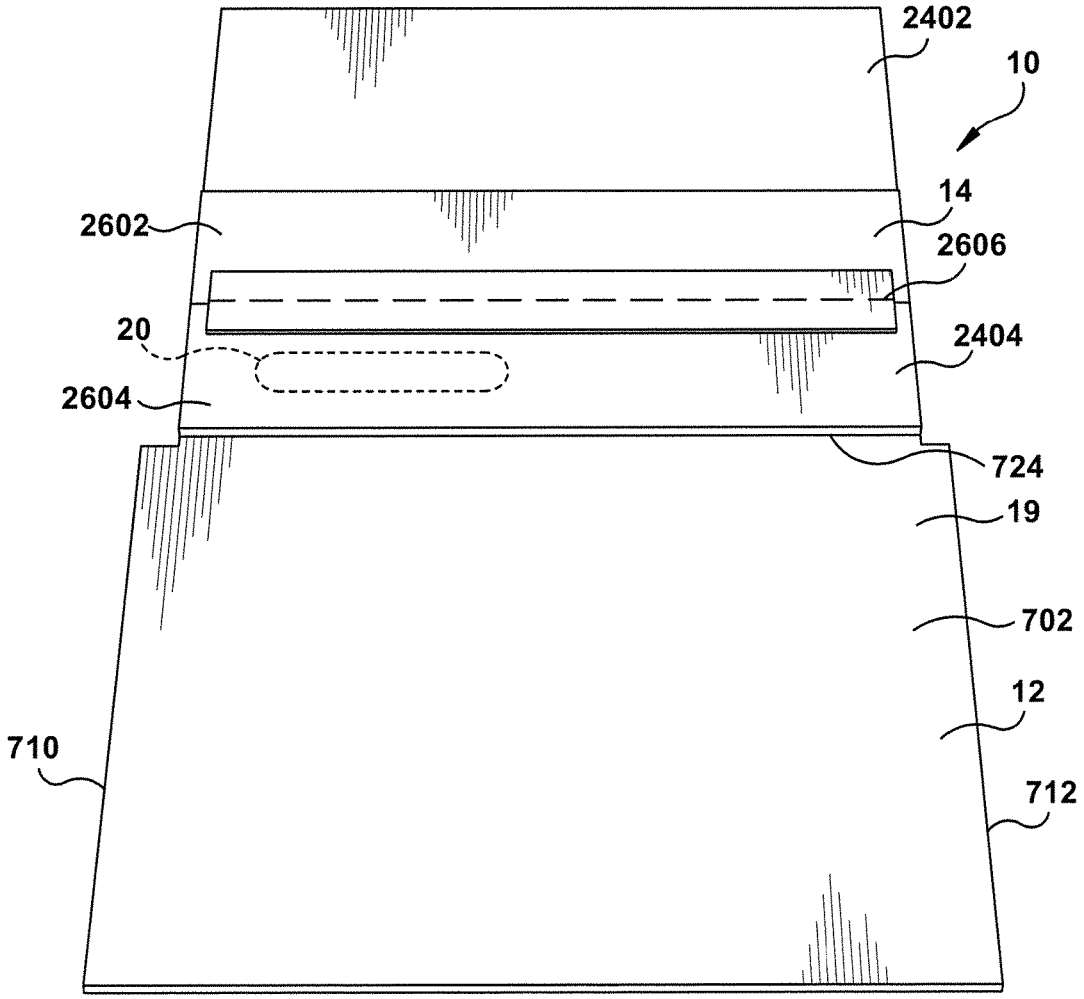
FIG. 27 is another perspective view of the laminated hip and ridge shingle illustrated by FIG. 26.

FIGS. 26 and 27 illustrate an exemplary embodiment that is similar to the embodiment illustrated by FIGS. 24 and 25. The embodiment illustrated by FIGS. 26 and 27 differs in that the dimensional layer 14 comprises two pieces or portions 2602, 2604 that are hingedly connected together. In one exemplary embodiment, the two portions 2602, 2604 are a single piece that can be folded to provide added dimension. The two portions 2602, 2604 of the single piece may be connected by a hinged connection 2606. In another exemplary embodiment, the two pieces 2602, 2604 are separate and are connected by a hinged connection 2606. This hinged connection 2606 allows the dimensional layer to provide different amounts of thickness to the laminated shingle 10. When the piece 2602 is against the base layer 12, the laminated shingle has two layers (i.e. the same as the other embodiments disclosed herein). When the piece 2602 is folded onto the piece 2604, the laminated shingle 10 has three layers (i.e. thicker than the other embodiments disclosed herein). The folding dimensional layer concept of FIGS. 26 and 27 can be applied to any of the embodiments disclosed herein. The hinged connection 2606 can take a wide variety of different forms. In the illustrated embodiment, the hinged connection 2606 is a piece of tape. The piece of tape may be perforated along the centerline of the tape. The tape can be applied in a wide variety of different ways, including, but not limited to any of the ways that the reinforcement material 35 is applied.

Each laminated shingle 10 of the array illustrated by FIGS. 26 and 27 includes a base layer 12 and a dimensional layer 14. Referring to FIG. 22, in an exemplary embodiment, a bottom surface 18 of the dimensional layer 14 is adhered to the top surface 19 of the base layer 12 by an adhesive 20. In the illustrated embodiment, the adhesive 20 extends only partially across the overlap between the base layer 12 and the dimensional layer 14. The portion of the base layer 12 that is not covered by the dimensional layer 14 is the portion of the shingle that will be exposed on the ridge of the roof. The dimensional layer 14 will be completely covered by the base layer 12 of the next shingle applied to the ridge 118. The dimensional layer 14 increases the thickness of the overlapping portions of two shingles 10. This provides the ridge 118 with a more dimensional appearance.

In the exemplary embodiment, the entire dimensional layer 14 is on top of the base layer 12 (i.e. complete overlap). This complete overlap reduces the possibility that water can pass between the layers 12, 14 where the adhesive is not present. By having the adhesive 20 extend only partially across the overlap between the first and second layers, the shingle 10 can be bent over the ridge 118 of the roof without tearing the top layer.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, hardware, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

While the present invention has been illustrated by the description of embodiments thereof, and while the embodiments have been described in considerable detail, it is not the intention of the applicant to restrict or in any way limit the scope of the invention to such detail. Additional advantages and modifications will readily appear to those skilled in the art. For example, the specific locations of the component connections and interplacements can be modified. Therefore, the invention, in its broader aspects, is not limited to the specific details, the representative apparatus, and illustrative examples shown and described. Accordingly, departures can be made from such details without departing from the spirit or scope of the applicant's general inventive concept.

The invention claimed is:

1. A laminated hip and ridge shingle comprising:

a base layer having a width and a length; and a dimensional layer having a width and a length;

wherein a machine direction of the base layer is along the width of the base layer, and wherein the width of the base layer has a first lateral side and a second lateral side;

wherein a machine direction of the dimensional layer is along the width of the dimensional layer, and wherein the width of the dimensional layer has a first lateral side and a second lateral side;

wherein the length of the dimensional layer is less than the width of the base layer; wherein the width of the dimensional layer is less than the width of the base layer, and wherein the length of the dimensional layer is less than the length of the base layer;

wherein the dimensional layer is affixed to the base layer such that the width of the dimensional layer is aligned with the width of the base layer by a line of an adhesive that extends along the width of the base layer and along the width of the dimensional layer;

wherein the line of adhesive is disposed between a top surface of the base layer and a bottom surface of the dimensional layer;

wherein the line of adhesive is disposed on only the first lateral side of the base layer and the first lateral side of the dimensional layer to allow movement of the second lateral side of the dimensional layer relative to the second lateral side of the base layer.

2. The laminated hip and ridge shingle of claim 1 wherein the base layer and the dimensional layer are made from a one single layer shingle blank.

3. The laminated hip and ridge shingle of claim 1 further comprising a sealant disposed on a bottom surface of the base layer for adhering the laminated hip and ridge shingle to an underlying laminated hip and ridge shingle.

4. The laminated hip and ridge shingle of claim 3 wherein the sealant extends along the width of the base layer.

5. The laminated hip and ridge shingle of claim 3 wherein the sealant comprises at least two parallel lines of sealant material that extend along the width of the base layer.

6. The laminated hip and ridge shingle of claim 3 further comprising a release tape disposed on a bottom surface of the base layer that is alignable with the sealant when two of the laminated hip and ridge shingles are stacked to prevent the two laminated hip and ridge shingles from sticking together.

7. The laminated hip and ridge shingle of claim 5 further comprising a release tape disposed on a bottom surface of the base layer that is alignable with the at least two parallel lines of sealant material of the sealant when two of the laminated hip and ridge shingles are stacked to prevent the two laminated hip and ridge shingles from sticking together.

8. The laminated hip and ridge shingle of claim 5 further comprising a single strip of release tape disposed on a bottom surface of the base layer that is alignable with the at least two parallel lines of sealant material of the sealant when two of the laminated hip and ridge shingles are stacked to prevent the two laminated hip and ridge shingles from sticking together.

9. A laminated hip and ridge shingle comprising:

a base layer having a width and a length;

a dimensional layer having a width and a length;

a sealant disposed on a bottom surface of the base layer for adhering the hip and ridge shingle to an underlying hip and ridge shingle; and a single strip of release tape disposed on the bottom surface of the base layer that is alignable with the sealant when two of the laminated hip and ridge shingles are stacked to prevent the two laminated hip and ridge shingles from sticking together;

wherein a machine direction of the base layer is along the width of the base layer;

wherein a machine direction of the dimensional layer is along the width of the dimensional layer;

wherein the length of the dimensional layer is less than the width of the base layer; wherein the width of the dimensional layer is less than the width of the base layer, and wherein the length of the dimensional layer is less than the length of the base layer;

wherein the dimensional layer is affixed to said base layer such that the width of the dimensional layer is aligned with the width of the base layer by a line of an adhesive that extends along the width of the base layer and along the width of the dimensional layer, and wherein the line of adhesive is disposed between a top surface of the base layer and a bottom surface of the dimensional layer;

wherein the sealant comprises at least two parallel lines of sealant material that extend along the width of the base layer;

wherein the single strip of release tape is alignable with the at least two parallel lines of sealant material of the sealant.

10. The laminated hip and ridge shingle of claim 9 wherein the base layer and the dimensional layer are made from a one single layer shingle blank.

11. The laminated hip and ridge shingle of claim 9 further comprising a sealant disposed on a bottom surface of the base layer for adhering the laminated hip and ridge shingle to an underlying laminated hip and ridge shingle.

12. A laminated hip and ridge shingle comprising:

a base layer having a width and a length; and a dimensional layer having a width and a length;

wherein the width of the base layer has a first lateral side and a second lateral side;

wherein the width of the dimensional layer has a first lateral side and a second lateral side;

wherein the length of the dimensional layer is less than the width of the base layer; wherein the width of the dimensional layer is less than the width of the base layer, and wherein the length of the dimensional layer is less than the length of the base layer;

wherein the dimensional layer is affixed to the base layer such that the width of the dimensional layer is aligned with the width of the base layer by a line of an adhesive that extends along the width of the base layer and along the width of the dimensional layer;

wherein the line of adhesive is disposed between a top surface of the base layer and a bottom surface of the dimensional layer;

wherein the line of adhesive is disposed on only the first lateral side of the base layer and the first lateral side of the dimensional layer to allow movement of the second lateral side of the dimensional layer relative to the second lateral side of the base layer.

13. The laminated hip and ridge shingle of claim 12 wherein the base layer and the dimensional layer are made from a one single layer shingle blank.

14. The laminated hip and ridge shingle of claim 11 wherein the sealant extends along the width of the base layer.

15. The laminated hip and ridge shingle of claim 11 wherein the sealant comprises at least two parallel lines of sealant material that extend along the width of the base layer.

16. The laminated hip and ridge shingle of claim 15 further comprising a single strip of release tape disposed on a bottom surface of the base layer that is alignable with the at least two parallel lines of sealant material of the sealant when two of the laminated hip and ridge shingles are stacked to prevent the two laminated hip and ridge shingles from sticking together.

17. The laminated hip and ridge shingle of claim 11 further comprising a release tape disposed on a bottom surface of the base layer that is alignable with the sealant when two of the laminated hip and ridge shingles are stacked to prevent the two laminated hip and ridge shingles from sticking together.

* * * * *